US007423935B2

(12) United States Patent
Oguchi

(10) Patent No.: US 7,423,935 B2
(45) Date of Patent: Sep. 9, 2008

(54) ELECTRONIC EQUIPMENT, AND RECEPTION CONTROL METHOD OF ELECTRONIC EQUIPMENT

(75) Inventor: Isao Oguchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 985 days.

(21) Appl. No.: 10/402,003

(22) Filed: Mar. 28, 2003

(65) Prior Publication Data

US 2003/0219039 A1 Nov. 27, 2003

(30) Foreign Application Priority Data

Mar. 29, 2002 (JP) ..... 2002-097282
Sep. 27, 2002 (JP) ..... 2002-283073

(51) Int. Cl.
*G04C 11/02* (2006.01)
*G04C 13/08* (2006.01)

(52) U.S. Cl. ..... 368/47; 368/59

(58) Field of Classification Search ..... 368/46, 368/47, 52, 55, 60, 59
See application file for complete search history.

(56) References Cited

U.S. PATENT DOCUMENTS 4,823,328 A * 4/1989 Conklin et al. ..... 368/47
5,274,545 A * 12/1993 Allan et al. ..... 368/156
5,422,863 A * 6/1995 Minowa et al. ..... 368/47
5,469,411 A * 11/1995 Owen ..... 368/47
5,528,560 A 6/1996 Ogiyama
5,717,661 A * 2/1998 Poulson ..... 368/202
5,918,041 A * 6/1999 Berstis ..... 713/503
6,312,153 B1 * 11/2001 Okada ..... 368/202
6,556,512 B1 * 4/2003 Winkler ..... 368/47

FOREIGN PATENT DOCUMENTS

| | | |
|---|---|---|
| DE | 44 03 124 | 8/1995 |
| DE | 100 04 985 | 8/2001 |
| JP | 7-109434 | 4/1995 |
| JP | 7-159559 | 6/1995 |
| JP | 08-136675 | 5/1996 |
| JP | 10-082875 | 3/1998 |
| JP | 11-148982 | 6/1999 |
| JP | 11-160468 | 6/1999 |
| JP | 2001-166071 | 6/2001 |
| JP | 2002-071853 | 3/2002 |
| JP | 2002-139585 | 5/2002 |
| WO | 91 11763 | 8/1991 |

* cited by examiner

*Primary Examiner*—Vit W Miska
(74) *Attorney, Agent, or Firm*—Rosalio Haro

(57) ABSTRACT

A radio wave correction timepiece has an antenna 21 for receiving external radio information including time information consisting of external time data, a reception circuit 22, and a time counter 53 for producing internal time data. A control circuit 24 has a comparison circuit 54 for determining the difference between received external time data and internal time data, and outputting a difference data value. A reception information storage unit 71 stores at least a plurality of data sets, each consisting of received external time data and its resultant difference data value. A correction calculation unit 62 calculates an estimated correction value using the plurality of stored data sets, and the elapsed time from the last reception. An internal time correction control unit 61 corrects the internal time using the estimated correction value.

28 Claims, 16 Drawing Sheets

71

| RECEPTION INFORMATION STORAGE UNIT | | | |
|---|---|---|---|
| | RECEPTION TIMING | DIFFERENCE (SECOND) | TIME CORRECTION (SECOND/DAY) |
| 1 | 2002/4/1 2:05:00 | 0.1 | 0.10 |
| 2 | 2002/4/2 2:05:00 | 0.08 | 0.08 |
| 3 | 2002/4/4 2:05:00 | 0.2 | 0.10 |
| 4 | 2002/4/5 2:05:00 | 0.15 | 0.15 |
| 5 | 2002/4/6 2:05:00 | 0.2 | 0.20 |
| 6 | 2002/4/7 2:05:00 | 0.15 | 0.15 |
| 7 | 2002/4/8 2:05:00 | 0.1 | 0.10 |
| AVERAGE VALUE | | | 0.13 |

FIG. 3

72

| RECEPTION SCHEDULE STORAGE UNIT | | | |
|---|---|---|---|
| SCHEDULE | CONTENT (NUMBER/DAY) | INTERVAL (DAY) | TIME |
| a | 1/1 | 1 | 2:00 AM |
| b | 1/2 | 2 | 2:00 AM |
| c | 1/3 | 3 | 2:00 AM |
| d | 1/4 | 4 | 2:00 AM |
| e | 2/1 | 12 HOURS | 2:00 AM |
| | | | 2:00 PM |

FIG. 4

ELECTRONIC EQUIPMENT, AND RECEPTION CONTROL METHOD OF ELECTRONIC EQUIPMENT

BACKGROUND OF THE INVENTION

1. Field of the Invention

The present invention relates to electronic equipment for receiving external radio information for self-correction and other operations, and a reception control method of the electronic equipment. More specifically, the present invention relates to electronic equipment represented by a radio wave correction timepiece capable of receiving external time information and performing time correction, and further relates to a reception control method of the electronic equipment.

2. Description of the Related Art

Widely known electronic equipment capable of receiving external radio information to correct the operation and execute specific tasks typically includes a radio wave correction timepiece for receiving external time information to perform time correction.

Such a radio wave correction timepiece has a forced reception function for forcing the receiving of a standard wave for time correction in response to a user operating a winding crown or button. The radio wave correction timepiece typically also has an automatic reception function for performing an automatic time correction operation at a predetermined time for information reception. For example, the standard wave may be received at two o'clock in the morning every day.

Incidentally, the accuracy of a typical quartz timepieces in recent years is generally ±20 seconds or less in Loss/Gain Monthly-rate, and the accuracy of some highly accurate quartz timepieces is ±10 seconds or less in Loss/Gain Yearly-rate. Thus, little error occurs during the timepiece's daily operation, and time correction is often unnecessary, even when receiving the standard wave for time correction purposes.

As a result, automatic time correction is not necessary meaning that execution of the radio wave reception operation has been wasteful resulting in needless power consumption. In particular, it is to be noted that the information reception operation consumes the most power in timepieces, and it therefore shortens the service life of a battery, such as used in battery driven wristwatches.

In order to reduce wasteful power consumption, a technique is known in which the interval between information reception operations is changed according to time correction by radio wave reception at a certain time, such as described in Japanese Laid-open Patent Application Publication No. Hei7-159559.

Another problem associated with the use of radio wave reception for receiving a time correcting information is that if electromagnetic noise is generated by an external magnetic field or an internal generator, the generated noise affects external radio information, and in some cases, correct time information cannot be acquired. Further, when the timepiece attempts to receive externally transmitted radio information while, by chance, the user is within a building, a subway, an underground passage, or other enclosed area where it is very difficult to accurately receive radio transmissions, the user will not be able to receive the radio wave and correct time information will not be acquired. In the above Japanese Laid-open Patent Application Publication, there occur problems in that since time information cannot be acquired, the internal time cannot be corrected by time information in such cases, and correct time data is less easily output.

This problem occurs not only in the radio wave correction timepiece, but also various kinds of electronic equipment for controlling specific operations by using correct time information such as personal computers, electronic toys, and timers.

Additionally in the above mentioned Japanese Laid-open Patent Application Publication, the next information-reception period is determined by the correction quantity at a certain time point without taking into consideration any circumferential changes such as the characteristic, service environment, and/or secular changes of an electric circuit, and if the correction quantity in one radio wave reception is by chance very small, reception in each hour can be received after at most 24 hours. Thus, there is a possibility that the time setting of the equipment may deviate largely (Loss/Gain) before the next information-reception period. Therefore, there exists that problem that the correct time may not be displayed in the above mentioned Japanese Laid-open Patent Application Publication.

Also in this Japanese Laid-open Patent Application Publication, indication error is easily generated if the correction quantity is large, and this problem is dealt with only by shortening the reception interval of the radio wave. Thus, there is a problem that the number of radio wave receptions is not reduced on a whole as expected, and the reduction effect of power consumption is limited.

OBJECTS OF THE INVENTION

A first object of the present invention is to provide an electronic equipment and a reception control method of the electronic equipment, capable of outputting substantially correct time data even when correct time information based on external radio information cannot be acquired.

A second object of the present invention is to provide an electronic equipment and a reception control method of the electronic equipment, capable of outputting more correct time data while reducing the power consumption required in reception.

A third object of the present invention is to provide an electronic equipment and a reception control method of the electronic equipment, capable of reducing the power consumption required in receiving and outputting correct time data even when a correction quantity is large.

SUMMARY OF THE INVENTION

The electronic equipment of the present invention includes an external radio information reception unit for receiving external radio information including time information, an internal time measuring unit for measuring the internal time based on a reference clock, a time data comparison unit for comparing external time data forming time information received by the external radio information reception unit with internal time data measured by the internal time measuring unit to output the difference therebetween, a storage unit, and a reception control unit, wherein the storage unit has a reception information storage unit storing at least a plurality of sets of each data on the timing of receiving the external radio information by the external radio information reception unit and the difference thereof, and wherein the reception control unit includes a correction calculation unit for calculating the estimated correction by the plurality of sets of reception timing data, difference data, and the elapsed time from the last reception, and an internal time correction control unit for correcting the internal time by using the estimated correction.

In the present invention, when external radio information is received by the external radio information reception unit, the received time information is compared with the internal time data measured based on the reference clock prepared inside the electronic equipment by the time data comparison unit, the difference therebetween is output, and the data including the difference and the reception timing is stored in the reception information storage unit.

In addition, the present invention includes the internal time correction control unit for calculating the estimated correction by a plurality of sets of last reception timing and difference based on the last reception data, and correcting the internal time by the value, and the internal time can be corrected based on the estimated correction even when time information based on external radio information cannot be acquired, or even when a user wishes to perform time correction at an arbitrary time without receiving external radio information, and generation of large time deviation can be suppressed.

Cases in which time information is unsuccessfully acquired (cannot be acquired) mean a case in which a user cannot receive external radio information when he wishes to received external radio information because he is within a building, a subway, etc. by chance, a case in which time information cannot be acquired because external radio information cannot be received due to the effect of electromagnetic noise inside and outside the electronic equipment, and a case in which correct time information could not be acquired because noise is superposed on external radio information, and erroneous data is received. Therefore, the internal time correction control unit preferably corrects the internal time by using the estimated correction when time information by receiving external radio information by, for example, the external radio information reception unit is unsuccessfully acquired.

In the present invention, the reception control unit has a reception schedule control unit for controlling the reception schedule in the external radio information reception unit, and wherein the internal time correction control unit preferably corrects the internal time by using the estimated correction when time information is unsuccessfully acquired in case external radio information is received based on the reception schedule.

According to the present invention, even when the time information based on radio information is unsuccessfully acquired in case automatically external radio information is received by the reception schedule control unit, the internal time can be corrected by the estimated correction, and generation of large time deviation can be suppressed.

In the present invention, the reception control unit has a reception schedule control unit for controlling the reception schedule in the external radio information reception unit, and the internal time correction control unit preferably corrects the internal time by using the estimated correction when reception is not performed though at the reception timing on the initially set reception schedule because the reception schedule is changed by the reception schedule control unit.

According to the present invention, time correction is performed using the estimated correction when reception is not performed at the timing for radio wave reception at the initial reception schedule, and substantially similar time accuracy to that with radio wave reception can be ensured without performing radio wave reception, and correct time data can be output.

In the present invention, the electronic equipment has an external operation unit for instructing the forced reception of external radio information by the external radio information reception unit, and the internal time correction control unit also corrects the internal time by using the estimated correction when time information by receiving the external radio information is unsuccessfully acquired in case the forced reception is instructed by operating the external operation unit by a user.

According to the present invention, even when time information based on the radio information is unsuccessfully acquired during the forced reception by manual operation, the internal time can be corrected with the estimated correction, and generation of large time deviation can be suppressed.

In the present invention, the electronic equipment has a magnetic field detection unit for detecting electromagnetic noise, and the reception control unit preferably has a reception processing control unit for prohibiting reception operation or invalidating reception data by the external radio information reception unit when detecting electromagnetic noise by the magnetic field detection unit.

According to the present invention, time information received by the external radio information reception unit is compared with internal time data by a time data comparison unit to output the difference therebetween, and the data including this difference and the reception timing is stored in the reception information storage unit.

In this case, electromagnetic noise such as high frequency noise and AC wave noise from the outside, and electromagnetic noise generated by the power generation by a generator when an electromagnetic generator generates the power when the electromagnetic generator is built in the electronic equipment, during radio wave reception, affects the external radio information reception unit, and then leading to a possibility that external radio information cannot be received, or noise is superposed on the radio information to receive erroneous data.

In the present invention, the reception control processing unit for prohibiting reception operation or invalidating reception data when detecting electromagnetic noise by the magnetic field detection unit is provided, and time correction, etc. based on external radio information affected by the noise, when electromagnetic noise is generated, is prevented from being performed.

In addition, even when time information cannot be acquired from external radio information due to the effect of electromagnetic noise, the estimated correction is calculated based on the last reception data, i.e., by the plurality of sets of last reception timing and difference quantity by the correction calculation unit and the internal time correction control unit, the internal time is corrected thereby, and generation of large time deviation can be suppressed.

In the present invention, the reception control unit comprises a reception schedule control unit for controlling the reception schedule in the external radio information reception unit, and, in case external radio information is received based on the reception schedule, the internal time correction control unit preferably corrects the internal time by using the estimated correction in case electromagnetic noise is detected by the magnetic field detection unit, and reception operation is prohibited or reception data is invalidated by the reception processing control unit, and then time information is unsuccessfully acquired.

In addition, the electronic equipment of the present invention comprises an external operation unit for instructing the forced reception of external radio information by the external radio information reception unit, and, in case the forced reception is instructed by operating the external operation unit by a user, the internal time correction control unit corrects the internal time by using the estimated correction in case electromagnetic noise is detected by the magnetic field detection unit, and reception operation is prohibited or reception data is invalidated by the reception processing control unit, and then time information is unsuccessfully acquired.

The internal time can be corrected by the estimated correction even when radio information with electromagnetic noise detected therein cannot be received during the automatic reception of external radio information by the reception schedule control unit or during the forced reception by manual operation, or reception data is invalidated, and time information cannot be acquired, and generation of large time deviation can be suppressed.

The electronic equipment of the present invention comprises an external radio information reception unit for receiving external radio information including time information, an internal time measuring unit for measuring the internal time based on the reference clock, a time data comparison unit for comparing external time data forming time information received by the external radio information reception unit with internal time data measured by the internal time measuring unit to output the difference therebetween, a storage unit, and a reception control unit, wherein the storage unit comprises a reception information storage unit storing at least a plurality of sets of each data on the timing of receiving the external radio information by the external radio information reception unit and the difference thereof, and wherein the reception control unit comprises a reception schedule control unit for controlling the reception schedule in the external radio information reception unit based on the plurality of sets of reception timing data and difference data stored in the reception information storage unit.

According to the present invention, the external radio information reception unit is operated according to the predetermined reception schedule by the reception schedule control unit, and receives external radio information. The received time information is compared with internal time data by the time data comparison unit to output the difference therebetween, and the data on the difference thereof and the reception timing are stored in the reception information storage unit.

The reception schedule control unit controls (changes) the reception schedule based on the respective data on the difference thereof and the reception timing. As described above, in the present invention, the future (next) reception schedule is controlled by using a plurality of sets of data received in the past, and compared with the case in which the reception interval is changed by only one reception data, the tendency of measuring error can be reliably grasped, and the reception interval can be adjusted. Thus, the possibility of error occurrence can be reduced, and deviation in time data output to a display unit can be minimized. In addition, since the reception interval can also be increased by changing the reception schedule, power consumption can be reduced, and in a case of a battery-driven system, the service life of a battery can be prolonged.

Here, a correction calculation unit for calculating the estimated correction by the plurality of sets of reception timing data, difference data, and the elapsed time from the last reception, and an internal time correction control unit for correcting the internal time by using the estimated correction are preferably provided.

In such a configuration, the estimated correction based on the difference and the reception timing is calculated even when the reception interval is increased, and time correction can be performed by the estimated correction, and only time correction can be performed without reception of the radio wave if the reception interval of the radio wave is increased, and the error in internal time data can be reduced.

The internal time correction control unit preferably corrects the internal time by using the estimated correction when reception is not performed, though at the reception timing according to the initially set reception schedule because the reception schedule is changed.

In such a configuration, time correction is performed using the estimated correction when reception is not performed at the timing for radio wave reception according to the reception schedule, and the time accuracy substantially similar to that with radio wave reception can be ensured even when radio wave reception is not performed, and correct time data can be output.

In the present invention, the reception schedule control unit preferably changes the reception schedule so that the reception interval is longer than the initially set value when the average value of the time correction value per unit time, obtained by the reception timing and difference thereof, is small and equal to or less than the first set value for the average value, and/or when the dispersion in the time correction value is small and equal to or less than the first set value for the dispersion.

In case the average value of the time correction value per unit time is small, the error therein can be suppressed to be small even when the time for no reception is prolonged in case the dispersion in the time correction value is small and equal to or less than the first set value for the dispersion, the error can be suppressed to be small by using the estimated correction even when the radio wave cannot be received.

Here, the first set value for the average value and the first set value for the dispersion may be appropriately set during the implementation, and for example, set according to the time accuracy, etc. requested for the electronic equipment. For example, when the accuracy of about 10 to 20 seconds in Loss/Gain Monthly-rate is obtained, the first set value for the average value may be equal to or less than 10 to 20 seconds/30 days in Loss/Gain Monthly-rate in terms of the time correction value per day, more specifically, about 0.25 seconds/day. The first set value for the dispersion is generally set to be smaller than the first set value for the average value, and may be set to be, for example, equal to or less than one half of the first set value for the average value, more specifically, about 0.1 seconds/day.

The reception interval may be set to be longer than the initial set value either when the average value of the time correction value is small and equal to or less than the first set value for the average value, or when the dispersion of the time correction value is small and equal to or less than the first set value for the dispersion. However, in case the time indication error is reliably reduced, the reception schedule may be changed so that the reception interval is longer than the initial set value when the average value of the time correction value is equal to or less than the first set value for the average value, and the dispersion of the time correction value is small and equal to or less than the first set value for the dispersion.

Accordingly, the reception interval can be set to be long, and the power consumption can be considerably reduced. While the error is small, and radio wave reception is not performed, time correction is not necessarily performed with the estimated correction, and power consumption can be reduced from this point.

In addition, in the present invention, the reception schedule control unit preferably changes the reception schedule so that reception interval is longer than the initially set value by skipping the reception timing in the initially set reception schedule for at least once. For example, in a schedule for reception once in a day in the initially set value, reception once may be skipped to the schedule of reception once in two days, or reception twice may be skipped to the schedule of reception once in three days.

In such a change of the reception schedule, the reception schedule can be easily changed.

In addition, in the present invention, the reception schedule control unit preferably changes the reception schedule so that the reception interval is shorter than the initial set value in case the average value of the time correction value per unit time, obtained with the reception timing and the difference thereof, is large and equal to or greater than the second set value for the average value, and/or in case the dispersion in the time correction value for each reception timing is large and equal to or greater than the second set value for the dispersion.

In case the average value of the time correction value is equal to or greater than the second set value for the average value, or "dispersion" is large and equal to or greater than "the second set value for the dispersion," the fluctuation per unit time is large, and there is a possibility that error occurs even when corrected with the estimated correction.

According to the present invention, even in such a case, the fluctuation can be reliably grasped and time correction can be performed, and the time accuracy can be improved by increasing the number of actual reception of the radio wave.

Here, the second set value for the average value may be equal to or greater than at least the first set value for the average value, the second set value for the dispersion may be equal to or greater than at least the first set value for the dispersion, and the specific value may be appropriately set in implementation. For example, each second set value is set to be equal to or less than two times each second set value, for example, about 1.2 to 1.5 times.

In case either the average value of the time correction value is large and equal to or greater than the second set value for the average value, or the dispersion in the time correction value is large and equal to or greater than the second set value for the dispersion, the reception interval may be shorter than the initially set value. However, in case the average value of the time correction value is equal to or greater than the second set value for the average value, and in case the dispersion in the time correction value is large and equal to or greater than the second set value for the dispersion, the reception schedule may be changed so that the reception interval is shorter than the initially set value.

As described above, in case the reception interval is set to be shorter only when both conditions are satisfied, priority can be given to suppression of the increase in power consumption required in reception compared with the improvement of the time accuracy by shortening the reception interval, and this method is effective when providing a power-saving mode, etc.

Here, in the present invention, the dispersion in the time correction value means the deviation to the regression equation when obtaining the regression formula (the regression equation) by each time correction value. The regression formula is generally a regression curve obtained by the least square method, but may be the regression curve such as a sine curve and a quadratic curve according to data.

Here, in the present invention, the storage unit has a reception schedule storage unit storing a plurality of sets of reception schedule information in an external radio information reception unit, and the reception schedule control unit preferably controls the reception schedule by selecting reception schedule information of the reception schedule storage unit.

In such a configuration, the schedule can be changed only by selecting reception schedule information, and the control thereof can be easily performed. In addition, the reception schedule storage unit for storing the selected reception schedule information is provided, and thus, schedule information of a user or when shipped from a factory can be set and stored, and the selected reception schedule information can be easily set and changed. Therefore, schedule information can be set according to the utilization situation of users and the kind of the electronic equipment, and optimum schedule control can be performed.

In the present invention, the internal time correction control unit preferably corrects the internal time by using the estimated correction in case the estimated correction calculated by the correction calculation unit is large and equal to or greater than the correction determination value.

In such a configuration, the time is corrected only when the estimated correction is large. In case the estimated correction is small and less than the correction determination value, and no indication error occurs, neither radio wave reception nor time correction is performed, and power consumption can be more reduced.

Here, in the present invention, a plurality of sets of reception timing data and difference data stored in the reception information storage unit are preferably the data of the latest predetermined number out of a plurality of sets of data received in the past.

In such a configuration, when the reception schedule and the estimated correction are set by using reception timing data and difference data for seven times in the past, the average value of the time correction value and the estimated correction can be calculated based on the recent tendency with the data for seven times in the past including the latest data in case new reception is performed, and the accuracy thereof can be improved.

The data for the predetermined times in the past need not be the continuously received data. This means that unsuccessful radio wave reception in the past attributable to the effect of electromagnetic noise, etc. may not be acceptably included, and the radio wave may be received predetermined times including the times therearound, and the data may be stored.

In the present invention, a setting changing unit for changing the setting of at least one of each set value and each determination value out of the respective set values and determination values is preferably provided.

By providing such a setting changing unit, a user can freely change and set each set value and determination value used for each determination according to the service situation and the external environment, and more appropriate control can be performed thereby.

And, in the present invention, the electronic equipment is preferably a radio wave correction timepiece having a display unit to indicate the internal time measured by the internal time measuring unit.

In this case, the display unit corrects the indication time according to correction of the internal time by using the estimated correction by the internal time correction control unit.

In case the electronic equipment of the present invention is applied to the radio wave correction timepiece, power consumption can be reduced, the service life can be prolonged even in a battery-driven mode, the accuracy of the indication time can be improved, and a timepiece of small error can be realized.

A reception control method of the electronic equipment of the present invention is a reception control method of the electronic equipment having an external radio information reception unit for receiving external radio information including time information and an internal time measuring unit for measuring the internal time based on the reference clock, and comprises a time data comparison step of comparing external time data forming time information received by the external radio information reception unit with internal time data measured by the internal time measuring unit and outputting the difference therebetween, a reception information storage step of storing at least a plurality of sets of each data on the timing of receiving the external radio information by the external radio information reception unit and the difference thereof, a correction calculation step of calculating the estimated correction by the plurality of sets of reception timing data, difference data, and the elapsed time from the last reception, and an internal time correction control step of correcting the internal time by using the estimated correction.

In the present invention, when external radio information is received by the external radio information reception unit, the received time information is compared with the internal time data measured based on the reference clock formed inside the electronic equipment in the time data comparison step, the difference therebetween is output, and the data of the difference thereof and the reception timing is stored in the reception information storage step. In addition, in the correction calculation step, the estimated correction is calculated based on the reception data in the past, i.e., by the data of the plurality of sets of the reception timing, difference, the elapsed time, etc. in the past, and in the internal time correction control step, the internal time is corrected by the estimated correction.

Thus, for example, when a user wishes to perform the time correction without receiving external radio information at an arbitrary time, the internal time can be corrected based on the estimated correction, and generation of large time deviation can be suppressed.

A reception control method of the electronic equipment of the present invention is a reception control method of the electronic equipment having an external radio information reception unit for receiving external radio information including time information and an internal time measuring unit for measuring the internal time based on the reference clock, and comprises a time data comparison step of comparing external time data forming time information received by the external radio information reception unit with internal time data measured by the internal time measuring unit and outputting the difference therebetween, a reception information storage step of storing at least a plurality of sets of each data on the timing of receiving the external radio information by the external radio information reception unit and the difference thereof, a correction calculation step of calculating the estimated correction by the plurality of sets of reception timing data, difference data, and the elapsed time from the last reception, and an internal time correction control step of correcting the internal time by using the estimated correction in case time information is successfully acquired when receiving external radio information by the external radio information reception unit.

According to the present invention, even when time information based on external radio information cannot be acquired such as when external radio information is unsuccessfully received, the internal time can be corrected based on the estimated correction, and generation of large time deviation can be suppressed.

A reception control method of the electronic equipment of the present invention is a reception control method of the electronic equipment having an external radio information reception unit for receiving external radio information including time information and an internal time measuring unit for measuring the internal time based on the reference clock, and comprises a time data comparison step of comparing external time data forming time information received by the external radio information reception, unit with internal time data measured by the internal time measuring unit and outputting the difference therebetween, a reception information storage step of storing at least a plurality of sets of each data on the timing of receiving the external radio information by the external radio information reception unit and the difference thereof, a correction calculation step of calculating the estimated correction by the plurality of sets of reception timing data, difference data, and the elapsed time from the last reception, a magnetic field detection step of detecting electromagnetic noise, a reception control step of prohibiting reception operation or invalidating reception data by the external radio information reception unit when detecting electromagnetic noise by the magnetic field detection step, and an internal time correction control step of correcting the internal time by using the estimated correction when prohibiting the reception operation or invalidating reception data in the reception control step.

According to the present invention, even when electromagnetic noise is detected, reception of external radio information is prohibited, or reception data is invalidated, the internal time can be corrected based on the estimated correction, and generation of large time deviation can be suppressed.

The reception control method of the electronic equipment of the present invention is a reception control method of the electronic equipment comprising an external radio information reception unit for receiving external radio information including time information, and an internal time measuring unit for measuring the internal time based on the reference clock, and comprises a time data comparison step of comparing external time data forming time information received by the external radio information reception unit with internal time data measured by the internal time measuring unit to output the difference therebetween, a reception information storage step of storing at least a plurality of sets of each data on the timing of receiving the external radio information by the external radio information reception unit and the difference thereof, and a schedule control step of controlling the reception schedule in the external radio information reception unit based on the plurality of sets of reception timing data and difference data stored in the reception information storage unit.

The reception control method preferably comprises a correction calculation step of calculating the estimated correction by the plurality of sets of reception timing data, difference data, and the elapsed time from the last reception, and an internal time correction control step of correcting the internal time by using the estimated correction.

Each reception control method has the same operational advantages as those of each invention of the electronic equipment including the above operational advantages.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIG. 3 shows the data configuration of a reception information storage unit according to the first embodiment.

FIG. 4 shows the data configuration of a reception schedule storage unit according to the first embodiment.

DESCRIPTION OF THE PREFERRED EMBODIMENTS

The embodiments of the present invention will be described below with reference to drawings.

First Embodiment

Figure 1:
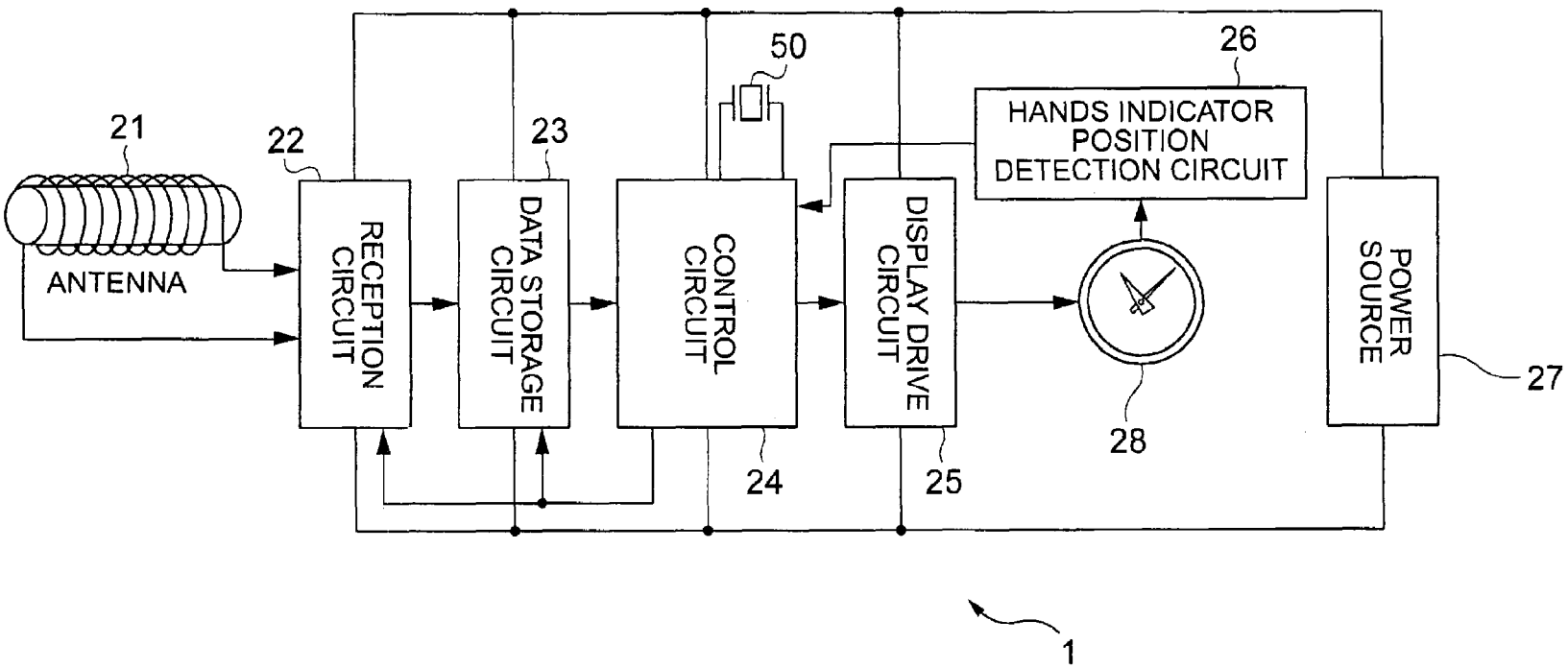
FIG. 1 shows the configuration of a radio wave correction timepiece according to a first embodiment of the present invention.

FIG. 1 shows the circuit configuration of a radio wave correction timepiece 1 according to a first embodiment.

The radio wave correction timepiece 1 has an antenna 21 for receiving a standard long wave (external radio information) with time information superposed thereon, a reception circuit 22 as a receiving means which processes the standard long wave from the antenna 21 and outputs it as time information (time code), a data storage circuit 23 for storing time information output from the reception circuit 22, a control circuit 24, a display drive circuit 25 for controlling the drive of a display unit 28 to display the time, hands indicator position detection circuit 26 for detecting the hands position of an indicator of the display unit 28, a battery 27 as a power source for driving each circuit, and the display unit 28 having indicators, such as an hours hand, a minutes hand, and a seconds hand, and having a motor for driving the indicators.

The antenna 21 is preferably a ferrite antenna with a coil around a ferrite rod.

The reception circuit 22 includes an amplifier circuit, a band pass filter, a demodulator circuit, and a decoding circuit (which are not shown). Reception circuit 22 captures time information (time code), which is in digital data form, from the received radio waves, and stores the time information in data storage circuit 23.

Thus, an external radio information reception unit in accord with the present invention includes antenna 21, reception circuit 22, and data storage circuit 23.

Figure 2:
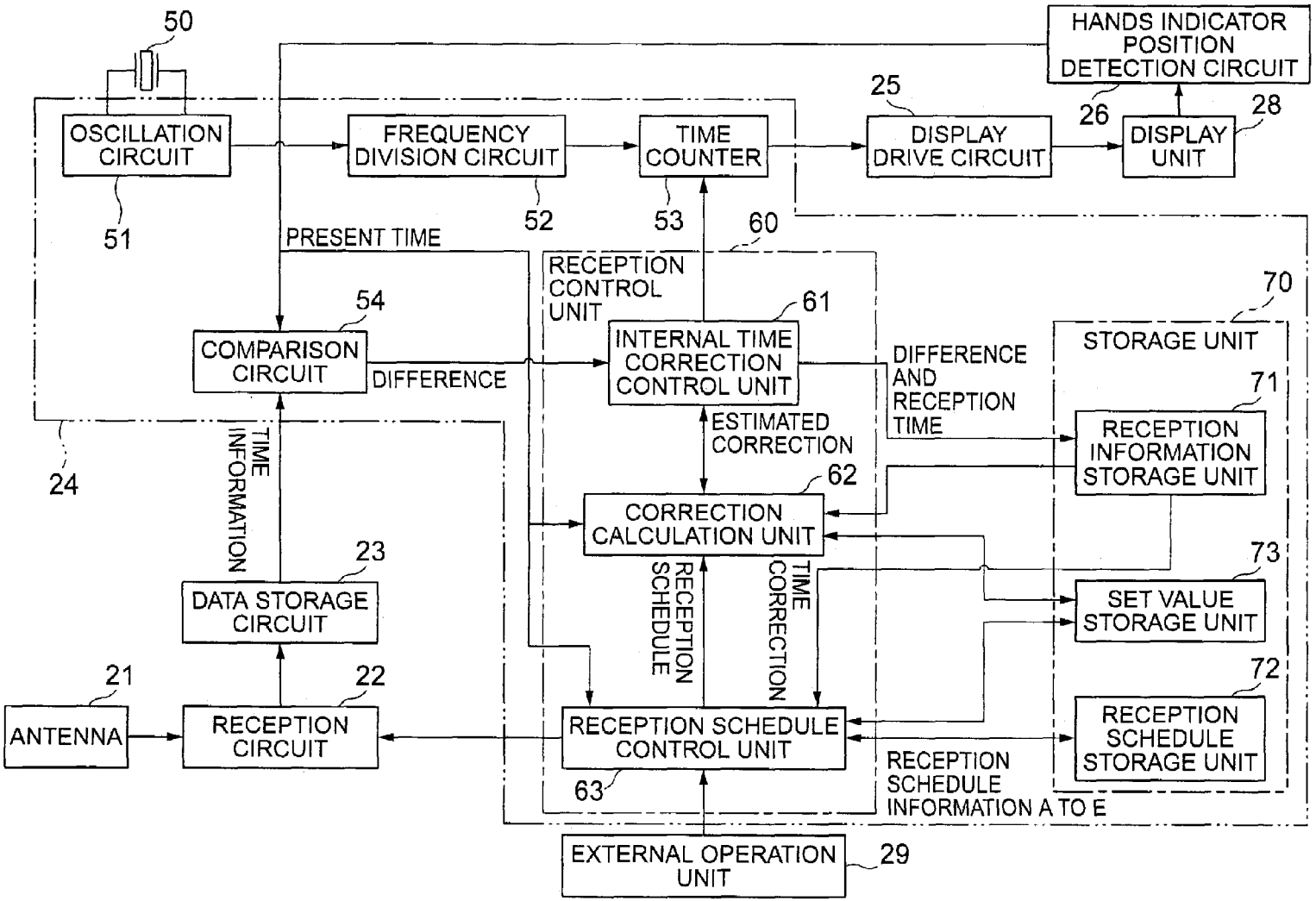
FIG. 2 is a block diagram of the configuration of a control circuit according to the first embodiment.

Time information stored in data storage circuit 23 is processed by control circuit 24. FIG. 2 shows the configuration of this control circuit 24.

With reference to FIG. 2, control circuit 24 includes an oscillation circuit 51, a frequency division circuit 52, a time counter 53, a comparison circuit 54, a reception control unit 60, and a storage unit 70.

Reception control unit 60 includes an internal time correction control unit 61, a correction calculation unit 62, and a reception schedule control unit 63.

Storage unit 70 includes a reception information storage unit 71, a reception schedule storage unit 72, and a set value storage unit 73.

Oscillation circuit 51 produces a high frequency oscillation using the reference oscillation source 50, which may be a quartz oscillator. Frequency division circuit 52 divides it's the oscillation signal from oscillation circuit. 51, and outputs it as a predetermined reference signal (for example, a signal of 1 Hz). The time counter 53 counts this reference signal to measure the passage of time.

Thus, an internal time measuring unit for measuring an internal time in accord with the present invention includes oscillation circuit 51, frequency division circuit 52, and time counter 53. Every time the time counter 53 counts up one, a drive signal is output to display drive circuit 25 to drive display unit 28, which includes an indicator and a stepping motor.

The position of the indicator is detected by the hands indicator position detection circuit 26, which outputs the detected position to the comparison circuit 54.

To assure that the received time information has not been corrupted by noise interference, the comparison circuit 54 first determines if the received time information (external time data) is a valid time measure, and if it is, then it assumes that the received time information is correct time data. As used herein, a valid time measure would be any realistic time reading such a 24 hour day, a 60 minute hour, and a 60 second minute. An invalid time measure would indicate corrupted data, and could be identified by any time measure outside normal parameters, such as an hour having more than 60 minutes or a day having more than 24 hours. Comparison circuit 54 then outputs the difference between the received time information and the internal time data as determined from the hands position read by the hands indicator position detection circuit 26. Thus, a time data comparison unit is constituted by the comparison circuit 54.

Various kinds of methods can be employed in a method for determining whether or not the received time information is valid. For example, a method for checking for valid time data can employ the point of view that the hour or the day value is unrealistic values such as 68 minutes. Alternatively, if the time information is expected at regular intervals, such as at 24 hour intervals, then valid data (i.e. uncorrupted data) can be determined by observing if the next received time information indicates the expected time lapse as incremented by the lapse of the regular intervals. As another example, if update time information is expected at 1 minute time intervals, then one can determine if each received time information value is valid data by determining if the received time information indicates an expected one minute time lapse since the previously received information value.

In the present embodiment, indicator position data of the hands indicator position detection circuit 26 is used for determining internal time data, but output data of the time counter 53 may also be used. In this case, the output of the time counter 53 may be input not only in the display drive circuit 25 but also in the comparison circuit 54. If such a configuration is employed, the hands indicator position detection circuit 26 may not be needed.

The internal time correction control unit 61 corrects the value of the time counter 53 based on the difference output data from the comparison circuit 54, and corrects the time display of the display unit 28 via the display drive circuit 25. The internal time correction control unit 61 further stores each difference output data in the reception information storage unit 71 at the time it receives the difference output data. In other words, the storing of the difference output data follows the time correction timing, which is the timing at which the external radio information is received.

In FIG. 3, and in the remainder of this discussion, the received time information is identified as "reception timing" data. Each pair of reception timing data and its corresponding difference output data constitutes a set of data stored in information storage unit 71. Each reception timing data and corresponding difference output data are stored in the reception information storage unit 71 from the latest reception timing tracing back to seven sets of data in the past. Further, the time correction value (seconds/day) obtained by the difference (second)/the reception interval (day) is also operated and stored. As shown in FIG. 3, data for date "2002 Apr. 3" is not stored. This is because the difference between the difference output data of the previous day "2002 Apr. 2" and the data of "2002 Apr. 3" was small, and the reception timing data for "2002 Apr. 3" was therefore skipped, and no data set was stored.

Returning to FIG. 1, the correction calculation unit 62 calculates an estimated time correction using a plurality of sets of data stored in the reception information storage unit 71. For example, a regression equation for regression line, etc. is obtained by using least square of data of seven time correction values, and the estimated time correction after a predetermined elapsed time from the most recently received reception timing data, for example, after one day is calculated based on the regression equation.

The reception schedule control unit 63 selects a reception processing schedule at the reception circuit 22 from each schedule information stored in the reception schedule storage unit 72, and changes it.

This means that, in the present embodiment, five kinds of reception schedule information including schedule information "a" to "e" is registered in advance in the reception schedule storage unit 72 as shown in FIG. 4. The reception schedule control unit 63 of FIG. 1 selects appropriate reception schedule information "a" to "e" based on the data stored in the reception information storage unit 71, and controls the operation of-the reception circuit 22 based on the information "a" to "e".

In the present embodiment, the reception schedule control unit 63 selects each set of reception schedule information "a" to "e" based on the average value of the time correction value and dispersion (the deviation from the regression equation) in the time correction value stored in the reception information storage unit 71 as described below.

Change of the schedule in the reception schedule control unit 63 is also notified to the correction calculation unit 62, and the correction calculation unit 62 instructs the time correction to the internal time correction control unit 61 according to the reception schedule and the estimated correction.

More specifically, if reception schedules "b" to "d" are selected, then an information reception operation is skipped once in a day, and if radio wave reception is not performed at two o'clock in the morning, which is the originally scheduled time for information reception, then the estimated time correction is calculated at that time and a time correction operation is performed with the calculated time correction if the correction value is not less than a correction determination value (i.e. a minimum required time correction value), for example, not less than 0.2 seconds. On the other hand, the time correction operation is not performed if the time correction is below the correction determination value.

When a user commands a forced reception by operating a external operation unit 29, such as a winding crown or button, the reception schedule control unit 63 operates the reception circuit 22 immediately irrespective of the reception schedule, and receives the external radio information.

The set value storage unit 73 stores respective set values (the first and second set values, i.e. predefined reference values for the average deviation and for the maximum permissible dispersion per time correction value) used for the determination in the reception schedule control unit 63, and the correction determination value used in the correction calculation unit 62.

The operation of the radio wave correction timepiece 1 of this configuration will be described below with reference to flowcharts in FIGS. 5 to 8.

In a normal state, the control circuit 24 determines the present time by using time counter 53 to count the reference clock, which may produce a 1 Hz output via oscillation circuit 51 and frequency division circuit 52. As the counter value of the time counter 53 changes, a drive pulse is output to a stepping motor of the display unit 28 from the display drive circuit 25, and each indicator is operated thereby.

On the other hand with reference to FIGS. 5-8, when the reception control unit 60 starts the operation, a variable N1 indicating the reception number is initialized to zero, and a variable N2 indicating the selected reception schedule is initialized to zero (Step 1; hereinafter, Step is abbreviated as "S"). In addition, the reception schedule control unit 63 selects reception schedule information "a" on the initial set values among reception schedule information "a" to "e" stored in the reception schedule storage unit 72, and controls it by the schedule for receiving radio wave once in a day (S2).

Successively, the reception schedule control unit 63 determines whether or not the forced reception is commanded by the external operation unit 29 (S3A). If the forced reception is not instructed, whether or not the reception timing is reached is determined (S3B). If the forced reception is instructed (S3A), or the reception timing is reached (S3B), the reception schedule control unit 63 drives the reception circuit 22 to perform the radio wave reception (S4).

For example, at the time immediately after the start, schedule information "a" (once/day) forming the initial set value is set, and at the time when the present time detected by the hands indicator position detection circuit 26 is set, for example, at two o'clock in the morning every day, the reception schedule control unit 63 drives the reception circuit 22 to perform radio wave reception (S4).

When the reception circuit 22 is operated, the standard wave is received by the antenna 21, and reception timing data (time information) is stored in the data storage circuit 23 via the reception circuit 22. The reception schedule control unit 63 operates the reception circuit 22 for about three minutes, and stops the reception circuit 22 when it receives time information for three frames.

The comparison circuit 54 checks that time information stored in the data storage circuit 23 is correct time data, i.e. valid time data, and thereby determines whether or not reception is successful (S5).

When it is determined that reception is successful in S5, the comparison circuit 54 calculates the difference between received time information and the present time detected by the hands indicator position detection circuit 26, and outputs the difference data to the internal time correction control unit 61.

The internal time correction control unit 61 corrects the data of the time counter 53 by using the difference data, and corrects the present time display of the display unit 28 via the display drive circuit 25 (S6).

In addition, the internal time correction control unit 61 stores the difference data, i.e., the time correction data, and the time of reception, i.e., the reception timing data in the reception information storage unit 71 (S7).

The reception control unit 60 adds 1 to the reception number N1 because the first reception has been performed (S8), and determines whether or not the reception number N1 is not less than a predetermined value, i.e., not less than 7 in the present embodiment (S9).

If N1 is less than 7 in S9, or it is determined by the comparison circuit 54 that reception is unsuccessful in s5, or it is waiting for the forced reception (S3A), or it is waiting for the scheduled information reception time (S3B), then the above processing steps S4-S9 are repeated.

On the other hand, if the reception number N1 is determined to be not less than 7, S9=Yes, then the reception control unit 60 changes the reception schedule of the reception schedule control unit 63 (S10), and the time correction with the calculated, estimated time correction value is performed by the correction calculation unit 62 (S11).

Sets of processing in S3A, S3B and subsequent ones are repeated based on the changed reception schedule.

In the present embodiment, process steps S10 and S11 are performed if N1 is not less than 7. This means that time information reception is performed seven times from the first time step S9 is executed, but this specific "number of determination" is not limited to seven, and may be appropriately set to 3, 5, 10, etc. during the implementation, or at any time.

In addition, in the present embodiment, after time information is received eight times from the start, N1 is sure to be not less than 7, and a process steps S10 and S11 are performed every time when reception of time information is successful. Alternatively, steps S10 and S11 may not be performed each time that time information is received starting on the eighth reception time, but may be performed every other reception time In addition, the number of data stored in the reception information storage unit 71 may be obtained by storing every data successful in reception from the starting point, and obtaining the average value, etc. of the time correction making use of the latest seven sets of data among every data, or only seven sets of data is consistently stored from the viewpoint of the storage capacity, and if new data is stored, the oldest data may be deleted. Thus, the average value of the time correction is the average value based on the time correction persistently when reception is successful, and does not include any estimated time correction values.

Changing of the reception schedule will be described with reference to the flowchart in FIG. 6.

Figure 6:
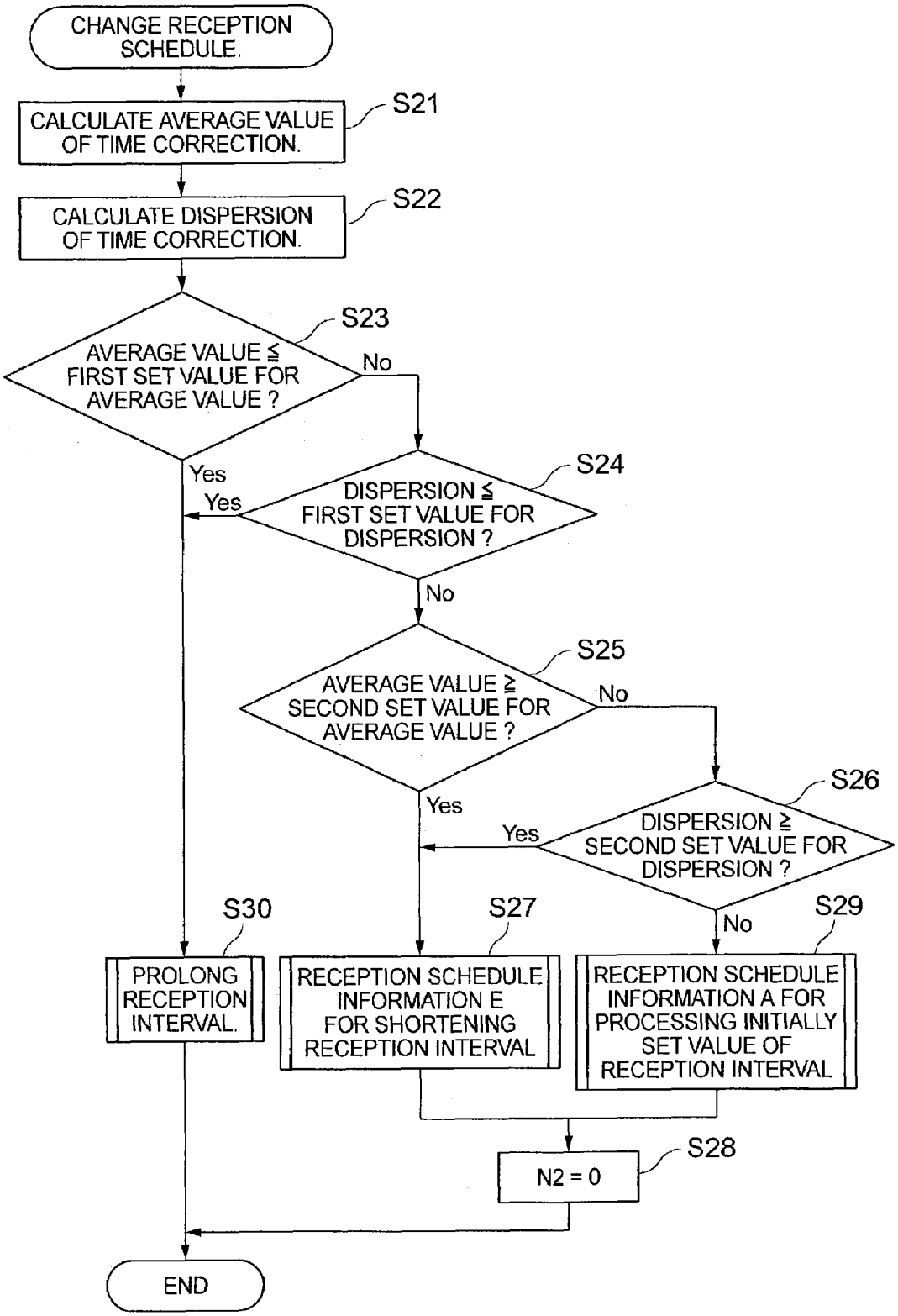
FIG. 6 is a flowchart showing the change of the reception schedule according to the first embodiment.

In the change reception schedule step (S10), the reception schedule control unit 63 first calculates the average value of the time correction value as shown in FIG. 6 (S21). In addition, dispersion in the time correction value is calculated (S22). "Dispersion" in the time correction value means the amount of deviation of each time correction value determined by the regression equation, and can be expressed, for example, by the standard deviation, etc. determined for each time correction value. In this case, "dispersion" means a measure of each value's deviation from the average.

Next, the reception schedule control unit 63 determines whether or not the average value is equal to or less than a first set value A1, i.e. a first reference average value A1, freely chosen a maximum permissible average value, and stored in the set value storage unit 73 (S23). The first reference average value A1 is appropriately set in implementation, and in the present example is preferably set to an average deviation value of 0.25 seconds/day.

Figure 9:
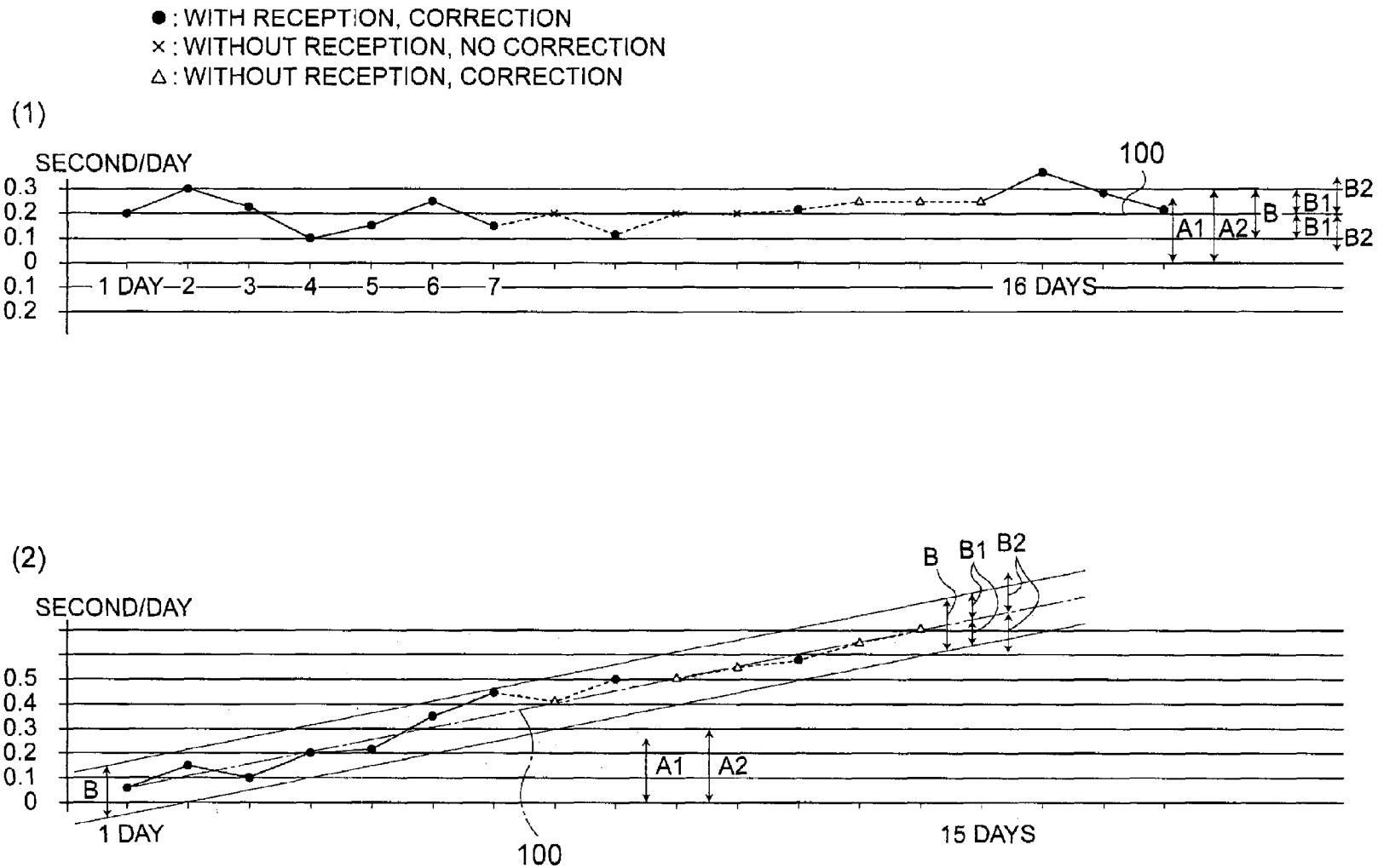
FIG. 9 shows two graphs illustrating changes in the time interval between time correction operations according to the first embodiment.

FIG. 9 shows two graphs with the activity of the present time correction invention shown for several days. In the graphs, a dot mark "•" indicates that remote time information was successfully received, and a time correction value was successfully calculated using the received time information. A triangular mark "Δ" indicates that reception of external time information was not successful, but that a time correction value was nonetheless successfully calculated using statistics from prior information receptions to interpolate a new time correction value. An x-mark "x" indicates that reception of external time information was not successful and that no time correction value could be successfully calculated.

In graph (1) of FIG. 9, the average of the time correction values calculated for seven days marked by a dot "•" (i.e. days where reception of external time information was successful) is about 0.21 seconds/day. This average is not greater than the first reference average value A1 of 0.25 seconds/day, and step S23 therefore yields "Yes", and the interval between information reception operations is extended (S30). In FIG. 6, "First Set Value For Average Value" refers to the set value of first reference average value A1. Since the interval between signal reception operations is lengthen, neither information reception nor time correction is performed on the eighth day.

As stated above in reference to FIG. 9, a dot mark "•" indicates the execution of a time correction operation by the comparison of the received external time information with the internal time in a day where information reception and time correction are performed. An x-mark "x" indicates that neither information reception nor time correction is performed. More specifically, this x-mark indicates the case where the average of time correction values for the previous seven days is not greater than the first set value A1, i.e. the first reference average value A1. In graph (1) of FIG. 9, the x-mark "x" is located on the line corresponding to 0.2 seconds/day, but this is indicated on a regression line 100 as described below for the convenience of graphical expression, and does not indicate any correction.

A triangular mark "Δ" indicates the estimated correction is corrected using the estimated correction value without any information reception. More specifically, this is a case where the average of the time correction values for the previous seven days, where information reception and time correction were performed, exceeds the first set value A1, i.e. the first reference average value Al.

When step S23 returns "No", the reception schedule control unit 63 determines whether or not dispersion in the time correction value is not greater than a first reference dispersion value B1, i.e. first set value B1 for the dispersion, which is stored in the set value storage unit 73 (S24). Even when the average of the time correction values is larger than the first reference average value A1, each time correction value can indicate a substantially constant tendency if its dispersion is not greater than the first reference dispersion value B1, and if each time correction value is located substantially along a path suggested by the regression equation (i.e. the regression line, etc.), then time correction can be performed using an estimated correction value, as described below, without performing a radio wave reception operation. The time interval till the next radio wave reception operation can therefore be prolonged.

Thus, for example, as shown in graph (2) of FIG. 9, if the regression line 100 of each time correction value increases at a relatively constant ratio, i.e. slope, the average of the time correction values will grow larger than the first reference average value A1. However, since each time correction value is within a range B around the regression line 100, and since the dispersion of each time correction value is not greater than the first reference dispersion value B1, the time interval till the next information reception operation can be extended (S30).

The range B shown in graphs (1) and (2) of FIG. 9 indicates the total +/− range of the first reference dispersion value B1. In graph (1), the regression line 100 is substantially agrees with the scale mark corresponding to 0.2 seconds/day. In graph 2, the regression line 100 is indicated by a line of alternating long and short dashes. In addition, the regression line 100 shown in graph (1) FIG. 9 indicates the regression line at the time point of the sixteenth day, i.e., the regression line of each time correction value for seven days performing reception and correction of the fourth, fifth, sixth, seventh, ninth, twelfth, and sixteenth days. Similarly, the regression line 100 shown in graph (2) FIG. 9 indicates the regression line of each time correction value for seven days performing reception and correction of the third to seventh, ninth, and twelfth days. The dispersion is expressed by the range around the regression line 100, and the range B indicates the +/−range of the first reference dispersion value B1 around the regression line 100.

For example, in graph (1) of FIG. 9, the lower limit of the range B is 0.1 seconds/day, the upper limit is 0.3 seconds/day, and the size of the range B is therefore 0.3-0.1=0.2 seconds/day. The first reference dispersion value B1=B/2=0.1 seconds/day.

On the other hand, if determination in S24 is No, the reception schedule control unit 63 determines whether or not the average of the time correction values is not less than a second set value A2, i.e. a second reference average value A2 (S25). This second reference average value A2 may only be larger than the first reference average value A1, and may be appropriately set in implementation. In the present embodiment, for example, in graph (1) of FIG. 9, the second reference average value A2 is set equal to 0.30 seconds/day, etc.

If the average of the time correction values is determined to be not less than the second reference average value A2 in S25, the reception schedule control unit 63 performs shortens the time interval till the next information reception operation (S27). More specifically, the reception schedule control unit 63 selects reception schedule information "e" from the reception schedule storage unit 72 (S27), and subsequent reception is performed every half day. The variable N2 indicating the kind of schedule information when prolonging the reception interval is reset to the initial value "0" because the reception interval is shortened (S28).

If determination in S25 is No, in other words, if the average value of the time correction values is larger than the first reference average value A1 and not larger than the second reference average value A2, the reception schedule control unit 63 determines whether or not the dispersion of the time correction value is not less than the second reference dispersion value B2 (the range around the regression line 100 similar to the first reference dispersion value Bi) (S26). Also when the dispersion is not less than the second reference dispersion value B2, the time interval till the next reception operation is shortened (S27).

If determination in S26 is No, in other words, if the average of the time correction value is between the first A1 and second A2 reference average values, and the dispersion of the time correction value is also between the first B1 and second B2 reference dispersion values, the reception schedule control unit 63 changes the schedule to schedule information "a" (once/day) of the initially set value (S29), and N2=0 in the processing S28.

The second reference dispersion value B2 must be not less than the first reference dispersion value B1, and may be appropriately set, and for example, set to be. 0.15 seconds/day, etc. If the second reference dispersion value B2 is the same as the first reference dispersion value B1, and the dispersion of the time correction value exceeds the range B, the reception interval (i.e. interval between information reception operations) is immediately shortened. On the other hand, if the second reference dispersion value B2 is larger than the first reference dispersion value B1, the time correction value is only reset to the initial schedule information "a" even when the dispersion exceeds the range B, and only when the second reference dispersion value B2 is exceeded, schedule information "e" is selected, and the reception interval is shortened.

For example, as shown on the sixteenth day in graph (1) of FIG. 9, if the average of the time correction values exceeds the first reference average value A1, the second reference average value A2, and the range B, schedule information "e" is selected, the reception interval is shortened, and reception and time correction is performed on the 16.5-th day. Subsequently, reception and time correction is performed every 0.5 day. However, if the time correction for the last seven days is completely within the range B, the reception interval is prolonged, returning to the reception once in a day again.

Figure 7:
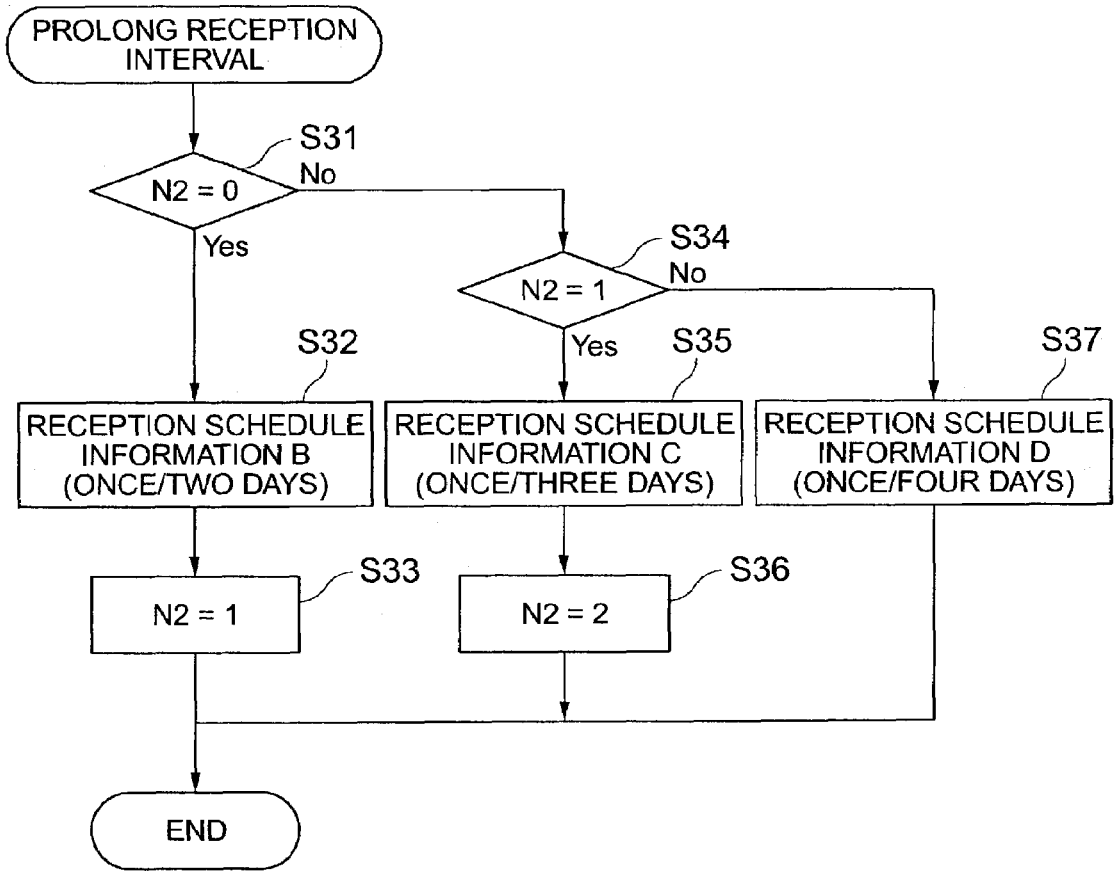
FIG. 7 is a flowchart showing the prolongation of the reception interval according to the first embodiment.

Next, prolongation of the reception interval (S30) is described based on the flowchart in FIG. 7.

In prolongation (S30) of the reception interval, the reception schedule control unit 63 firstly determines whether or not N2 is "0" (S31). When prolongation of the reception interval (S30) is performed, because of N2=0, reception schedule information "b" is selected (S32), and N2 is updated to "1" (S33). Thus, the subsequent reception timing becomes once every two days. More specifically, the reception timing is set so as to perform reception in two days after the date of last reception.

In addition, if prolongation of the reception interval (S30) is performed while present reception schedule information "b" is selected, the reception schedule control unit 63 determines No in S31 because N2=1, and further determines whether or not N2=1 (S34). Here, determination becomes Yes, reception schedule information "c" is selected (S35), and N2 is updated to "2". Thus, the next reception timing becomes the same one after three days.

In addition, if prolongation of the reception interval (S30) is performed while present reception schedule information "c" is selected, the reception schedule control unit 63 determines No in S31 and S34, respectively, because N2=2, and reception schedule information "d" is selected (S37). N2 is left unchanged from "2". Thus, the next reception timing becomes the same one after four days.

In the present embodiment, only at most one schedule information "d" in four days is set. Thus, even of prolongation of the reception interval (S30) is performed while present reception schedule information "d" is selected, prolongation is performed with the unchanged reception schedule information "d" and S37 is processed. In prolongation of the reception interval, prolongation of the reception interval longer than schedule information "d" can be repeated. However, as illustrated in the present embodiment, the reception interval is preferably stopped to a predetermined value. For example, if radio wave reception is not performed for a period as long as one to six months, any correct time data cannot be obtained, leading to the possibility that correct time cannot be displayed.

As described above, when changing of the reception schedule (S10) is completed, time correction (S11) with the estimated correction is performed successively.

Figure 8:
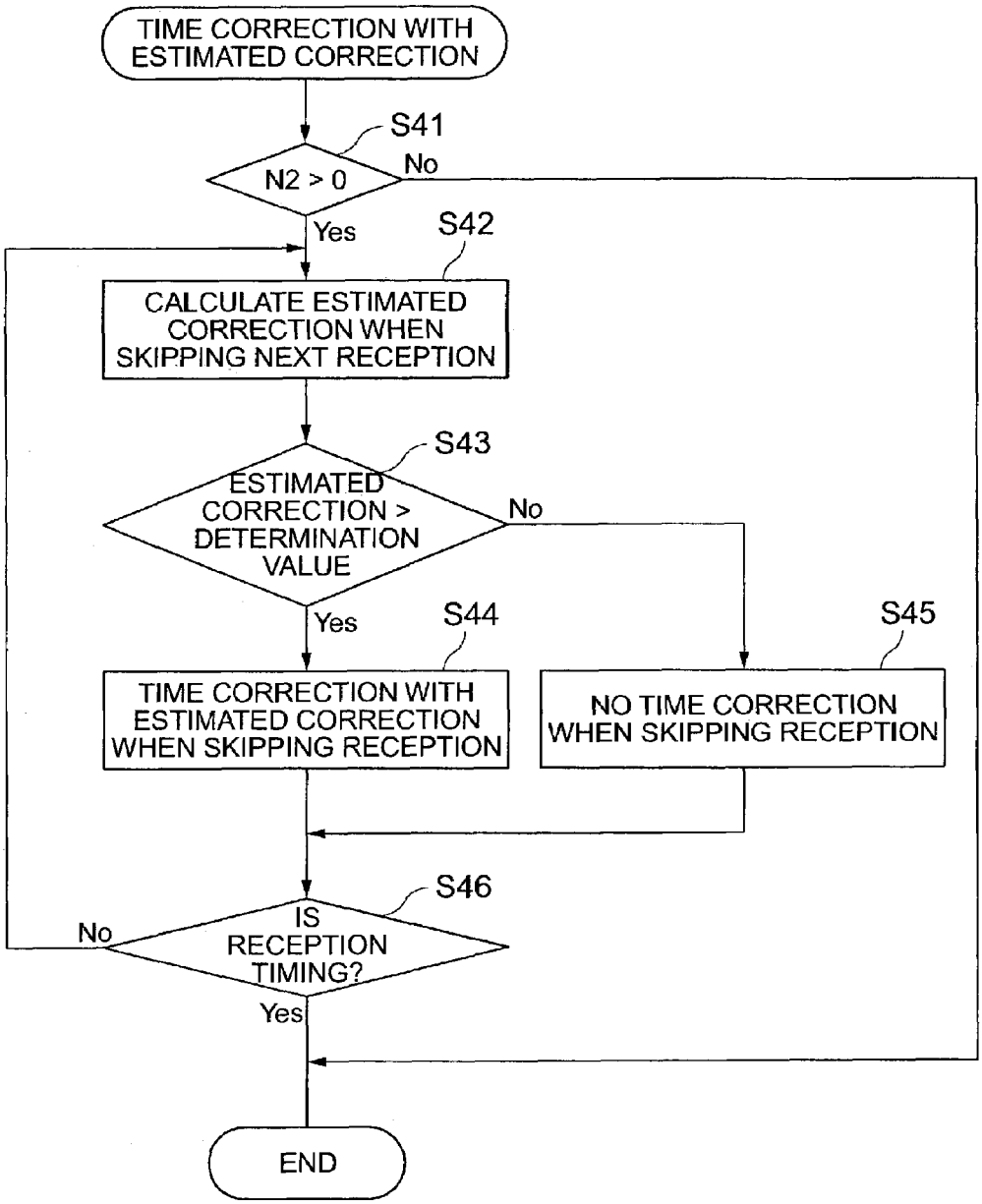
FIG. 8 is a flowchart showing the time correction in the estimated correction according to the first embodiment.

In this time correction, the correction calculation unit 62 determines whether or not N2 is larger than 0 as shown in the flowchart of FIG. 8 (S41). Time correction with the estimated correction performs only time correction when the reception interval is prolonged from the initially set schedule of once in a day, and radio wave reception is skipped. Thus, time correction is performed only in cases of reception schedule information "b" to "d", i.e., N2=1, 2. Thus, if N2=0, time correction is completed without any operation.

On the other hand, if determination in S41 is Yes, the correction calculation unit 62 calculates the estimated correction at the scheduled date for skipping the next reception (S42). More specifically, the estimated correction may be calculated by substituting the skipping date in the above regression equation.

If the estimated correction is larger than the correction determination value, the correction calculation unit 62 performs time correction with the estimated correction at the skipped reception schedule time (S44).

On the other hand, if the estimated correction is equal to or less than the determination value, indication error is estimated to be smaller even when no time correction is performed, and the reception schedule control unit 63 and the correction calculation unit 62 perform neither radio wave reception nor time correction (S45).

The correction calculation unit 62 determines whether or not the next reception timing is reached (S46), and if the reception timing is not reached, the above steps S42 to S45 are repeated. In other words, if reception schedule information "c" and "d" is selected, the reception date is skipped two or three times before the next reception. Thus, the correction calculation unit 62 calculates the estimated correction in each skip, and appropriately performs time correction based on the value.

On the other hand, when it is determined in S46 that the reception timing is reached, the correction calculation unit 62 completes time correction S11, and processing is repeated from S3A.

According to the present embodiment, the following advantages can be obtained.

(1) In the present embodiment, if radio wave reception cannot be performed, correct data cannot be received due to the influence of noise, etc., or correct time information cannot be acquired, the correction calculation unit 62 calculates the estimated correction, and corrects the internal time using the estimated correction. Additionally, when time correction by external radio information cannot be performed, indication error of time can be kept small, realizing an electronic equipment with high time indication accuracy.

In addition, even when the radio wave reception interval is increased by the change of the reception schedule, time correction can be appropriately performed by using the estimated correction, and indication error can be reduced. Thus, the less easily compatible technical advantages of reduction of power consumption and improvement of time indication accuracy can be simultaneously achieved.

(2) In addition, the correction calculation unit 62 performs time correction only when the estimated correction is not less than the determination value, but it does not perform time correction if the estimated correction is equal to or less than the determination value, and power consumption can be reliably reduced more than a case when time correction is performed.

(3) The reception schedule control unit 63 changes and controls the subsequent reception schedule based on reception timing data and difference data obtained through a plurality of sets of reception, and compared with a case in which the reception interval is changed only in once reception, the schedule can be set based on more correct reception information, the possibility of error occurrence can be reduced, and the deviation in time data output in the display unit 28, etc., i.e., indication error can be minimized.

In addition, the reception interval can be increased by changing the reception schedule, and power consumption can be reduced. Thus, when a portable electronic equipment, like a wristwatch, is driven by a battery, the service life of the battery can be prolonged. Accordingly, the duration can be increased from the conventional value for the electronic equipment having a process of reception operation consuming much power.

(4) In addition, in the present embodiment, the reception schedule control unit 63 successively selects initial reception schedule information "a" once in a day, reception schedule information "b" once in two days, reception schedule information "c" once in three days, and reception schedule information "d" once in four days so as to gradually prolong the reception interval, and power consumption can be further suppressed. In addition, prolongation of these reception intervals is performed when the average value of the time correction value is equal to or less than the first reference average value A1, the dispersion in the time correction value is equal to or less than the first reference dispersion value B1, and fluctuation is small, and little error occurs in time indication even when the radio wave reception interval is prolonged.

(5) Still further, when changing the reception schedule, determination is performed not only by the average value of the time correction value but also by the dispersion in the time correction value, and the reception interval can be prolonged more often compared with a case in which determination is performed only be the average value of the time correction value, and power consumption can be reduced more. In other words, when determination is performed only by the average value of the time correction value, the radio wave reception interval cannot be prolonged if the average value is higher than the first reference average value A1. On the other hand, if the dispersion is smaller though the average value of the time correction value is higher, the radio wave reception interval is prolonged, and power consumption of the radio wave correction timepiece 1 can be further reduced.

(6) In addition, the reception schedule control unit 63 not only prolongs the reception interval but also shortens the reception interval when the dispersion in the time correction value is larger than the second reference dispersion value B2, or when the average value of the time correction value is larger than the second reference average value A2, and optimum radio wave reception control for the situation can be performed, time correction by radio wave reception can be reliably performed, and time indication accuracy can be improved thereby.

(7) Since the forced reception can be performed by providing the external operation unit 29, users can perform radio wave reception at free timing by the reception schedule control unit 63 even when the reception schedule interval is prolonged, and even when error occurs in time indication by prolongation of the reception interval, the error can be corrected immediately if users perform the forced reception as necessary, and no problems occur in practical applications.

(8) Since the reception schedule storage unit 72 and the set value storage unit 73 are provided, each reception schedule information, each set value, and each determination value can be easily changed or added. Thus, such information can be easily set be users according to each model and service conditions, or when the product is shipped from the factory.

Second Embodiment

The second embodiment of the present invention will be described with reference to FIGS. 10 to 12. The components in the present embodiment which are identical to, or correspond to, those in the first embodiment are represented by the same reference characters, and a detailed description thereof is omitted.

Figure 10:
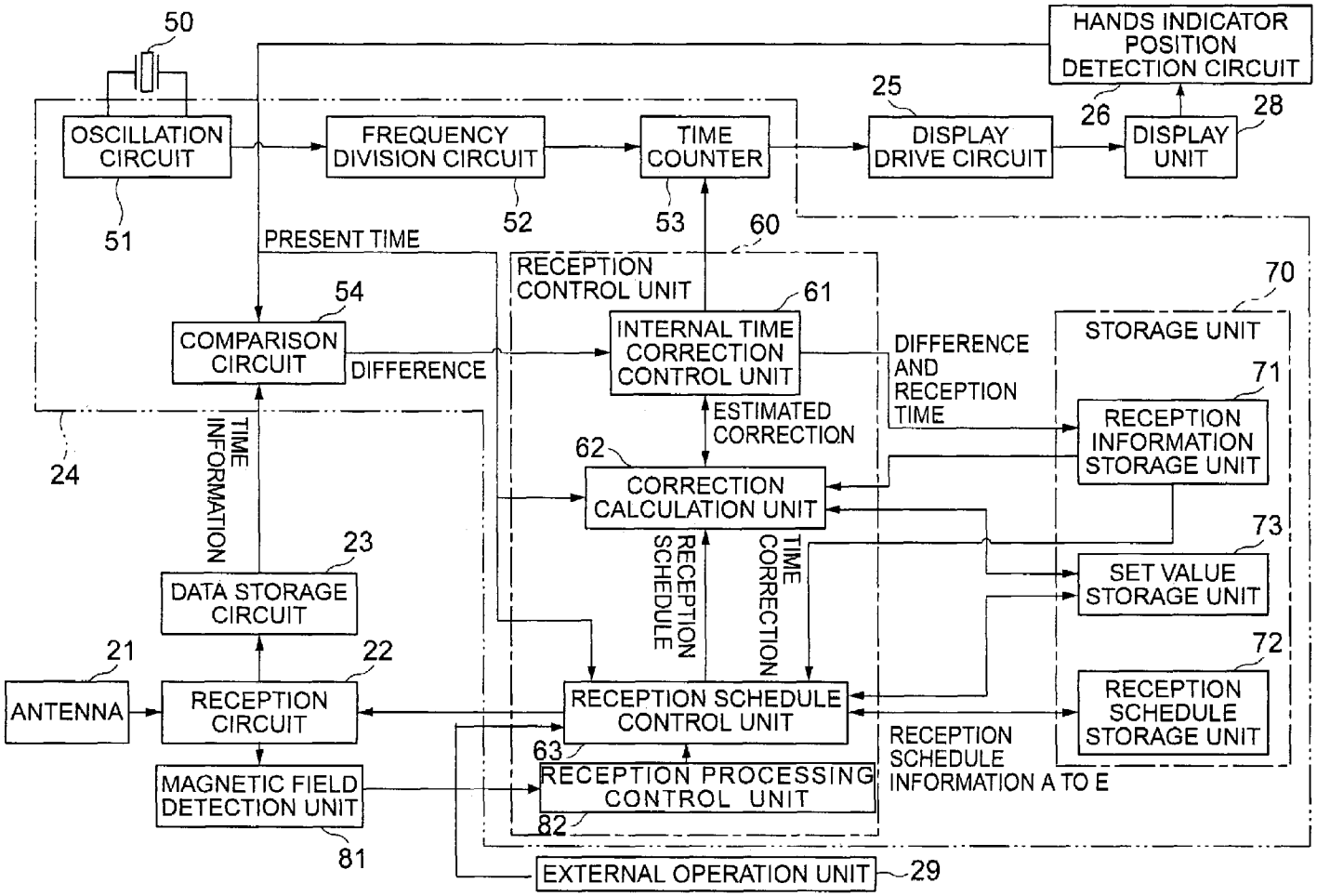
FIG. 10 is a block diagram showing the configuration of a control circuit according to a second embodiment of the present invention.

The radio wave correction timepiece 1 according to the second embodiment is different from that in the first embodiment only in that a magnetic field detection unit 81 and a reception processing control unit 82 are added, as shown in FIG. 10. Other features of the configuration are the same as those of the first embodiment.

The magnetic field detection unit 81 detects electromagnetic noise by using at least the antenna 21 and the reception circuit 22. The electromagnetic noise includes those noise elements generated by external magnetic fields applied from external appliances such as an AC magnetic field and a high frequency magnetic field, and also includes noise elements from the internal electromagnetic interference due to the operation of a generator disposed inside the appliances.

The magnetic field detection unit is not limited to one comprising the antenna 21 and the reception circuit 22, but any magnetic field detection unit capable of detecting electromagnetic noise may be acceptable. For example, a magnetic field detection unit may be acceptable in which a drive coil of a stepping motor in the display unit 28 is used as the antenna, and its drive circuit is utilized for a magnetic field detection circuit. Alternatively, when an AC generator is built in, the magnetic field can be detected by the magnetic field detection circuit by using its power generation coil as the antenna, or electromagnetic noise may be detected by using a power generation detection circuit for detecting a power generation state from the generated power induced in the power generation coil, etc.

The reception processing control unit 82 controls so as to abort information reception if electromagnetic noise predetermined intensity is detected, even if the the schedule in reception schedule control unit 63 indicates that it is time execute an information reception operation.

Figure 11:
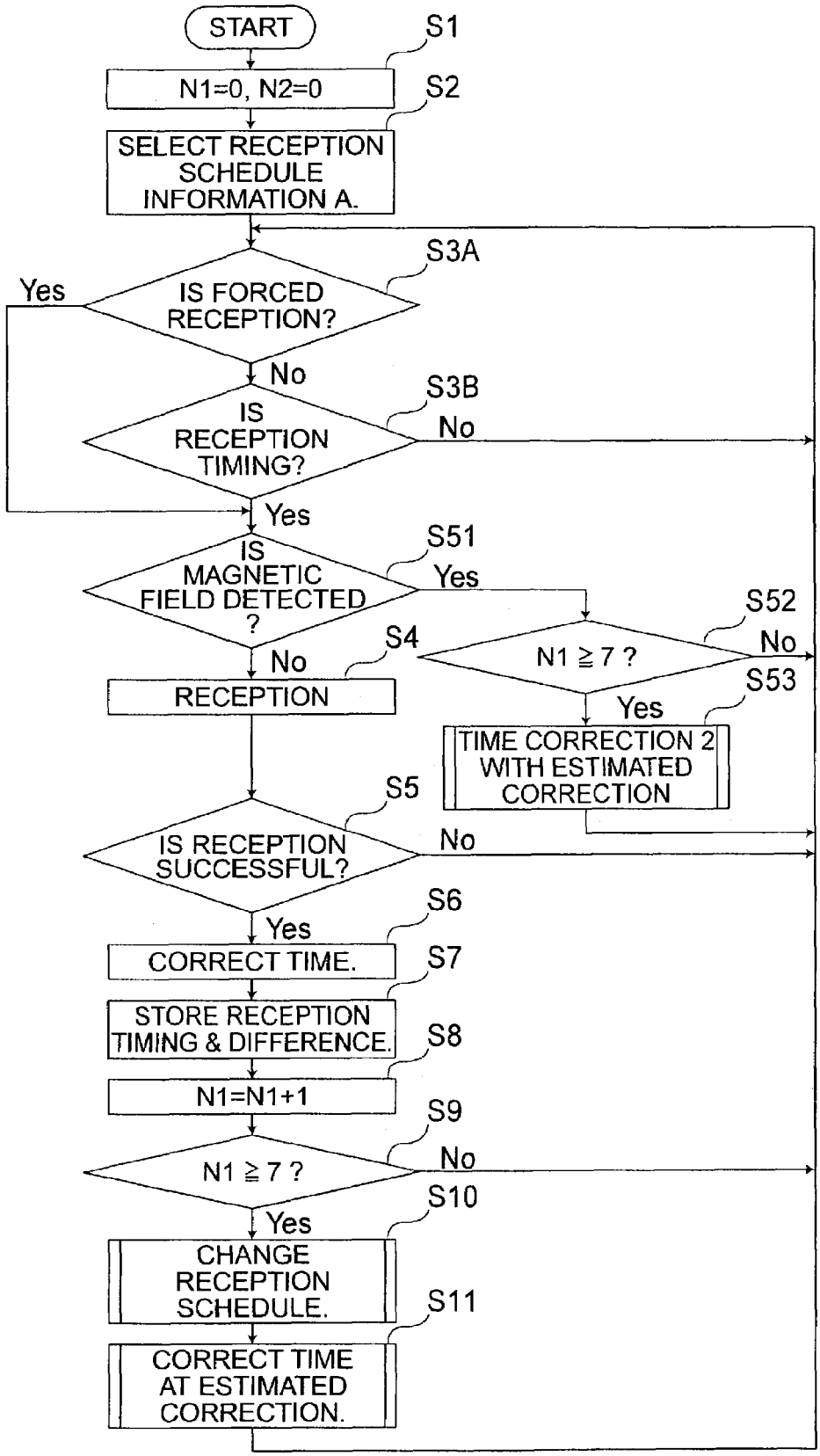
FIG. 11 is a flowchart showing the operation of the control circuit according to the second embodiment.
Figure 12:
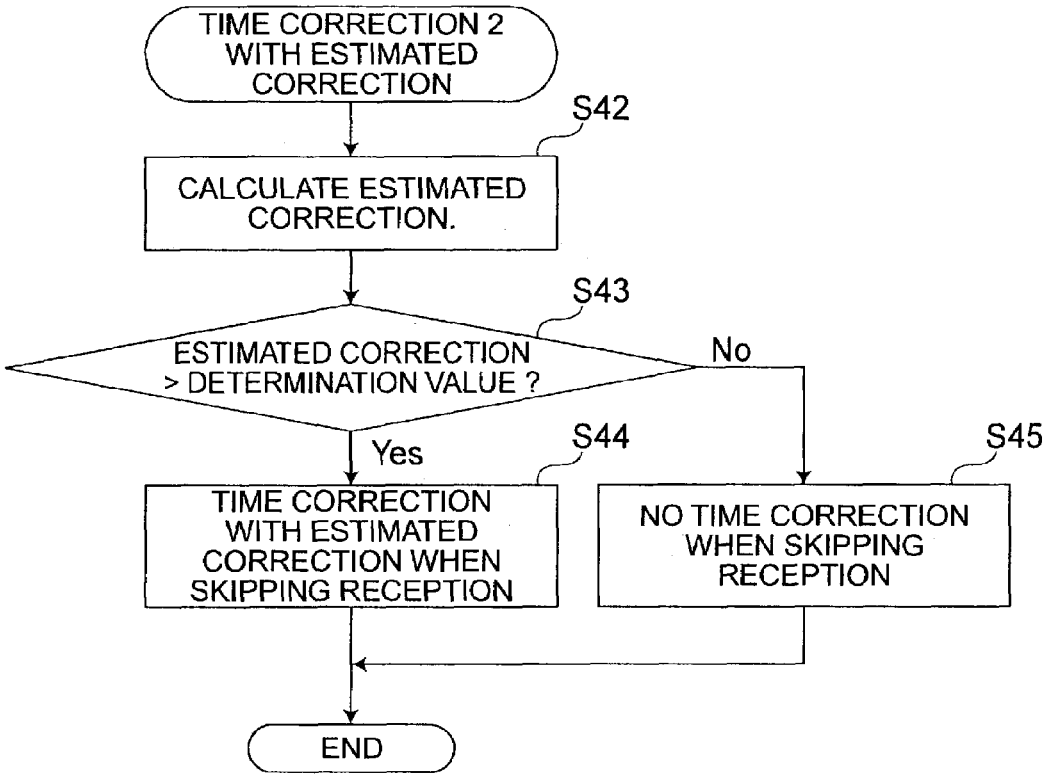
FIG. 12 is a flowchart showing the time correction in the estimated correction according to the second embodiment.

Control is performed as shown in FIGS. 11 and 12 in the second embodiment.

This means, as shown in FIG. 11, that when the reception schedule control unit 63 determines that a forced reception command is present (S3A) or that its time for a scheduled information reception operation (S3B), the reception step (S4) is not immediately performed, but rather the reception processing control unit 82 first determines if the magnetic field detection unit 81 detected the presence or absence of a magnetic field greater than a predetermined magnitude, i.e. detected the presence or absence of electromagnetic noise. If such a magnetic field was detected, then information reception is aborted, and reception processing control unit 82 notifies the reception schedule control unit 63 that no information reception operation will be executed If a magnetic field greater than the predetermined magnitude is not detected, then reception schedule control unit 63 performs the same processes as that of the first embodiment continuing from reception step (S4).

However, if a magnetic field greater than the predetermined magnitude is detected in step S51, the reception schedule control unit 63 determines whether or not information reception operations have been performed at least seven times (S52) in the past. If the number of information reception operations is below seven, the calculation accuracy of the estimated correction value is deemed to be not sufficient for accurate use, and the process is returned to step (S3), without attempting information reception, to wait for the next scheduled information reception time or for the next forced reception command.

If it is determined in step S52 that information reception operations have been performed at least seven times, the information of the prior information reception operations is transferred from the reception schedule control unit 63 to the correction calculation unit 62, and the correction calculation unit 62 performs time correction (S53) with the estimated processing quantity.

Because time correction according to the present embodiment is performed if electromagnetic noise is detected at the time when radio wave reception is performed, the processing flow according to the second embodiment is different from the processing flow in FIG. 8 in that checking of reception schedule information in S41 and determination of the next reception timing in S46 are omitted, and there is no difference in other processing. Accordingly, the description thereof will be omitted.

This embodiment includes not only every advantages of the first embodiment but also advantages shown below.

(9) Since the magnetic field detection unit 81 and the reception processing control unit 82 are provided, execution of radio wave reception can be prevented if electromagnetic noise levels capable of affecting information reception are detected during preparation for a radio wave reception operation. Thus, receiving corrupted time information due to the effect of electromagnetic noise is prevented, and time accuracy can be improved because time correction operations are performed only when correct radio wave information is received.

(10) In addition, even when radio wave time information cannot be received due to electromagnetic noise, a time correction operation is performed using an estimated correction value, and further generation of time indication error can be suppressed. Typically, if radio wave reception cannot be accurately performed due to electromagnetic noise, radio wave reception must generally be attempted again after one hour, or so. However, in the present embodiment, a time correction operation can be completed by using the estimated correction value even if external time information cannot be accurately received, and radio wave reception need not be attempted again. This further reduces power consumption.

Third Embodiment

The third embodiment of the present invention will be described with reference to FIGS. 13 and 14. The components in the present embodiment which are identical to or correspond to those in the first and second embodiments are identified by the same reference characters, and a description thereof is omitted.

Figure 13:
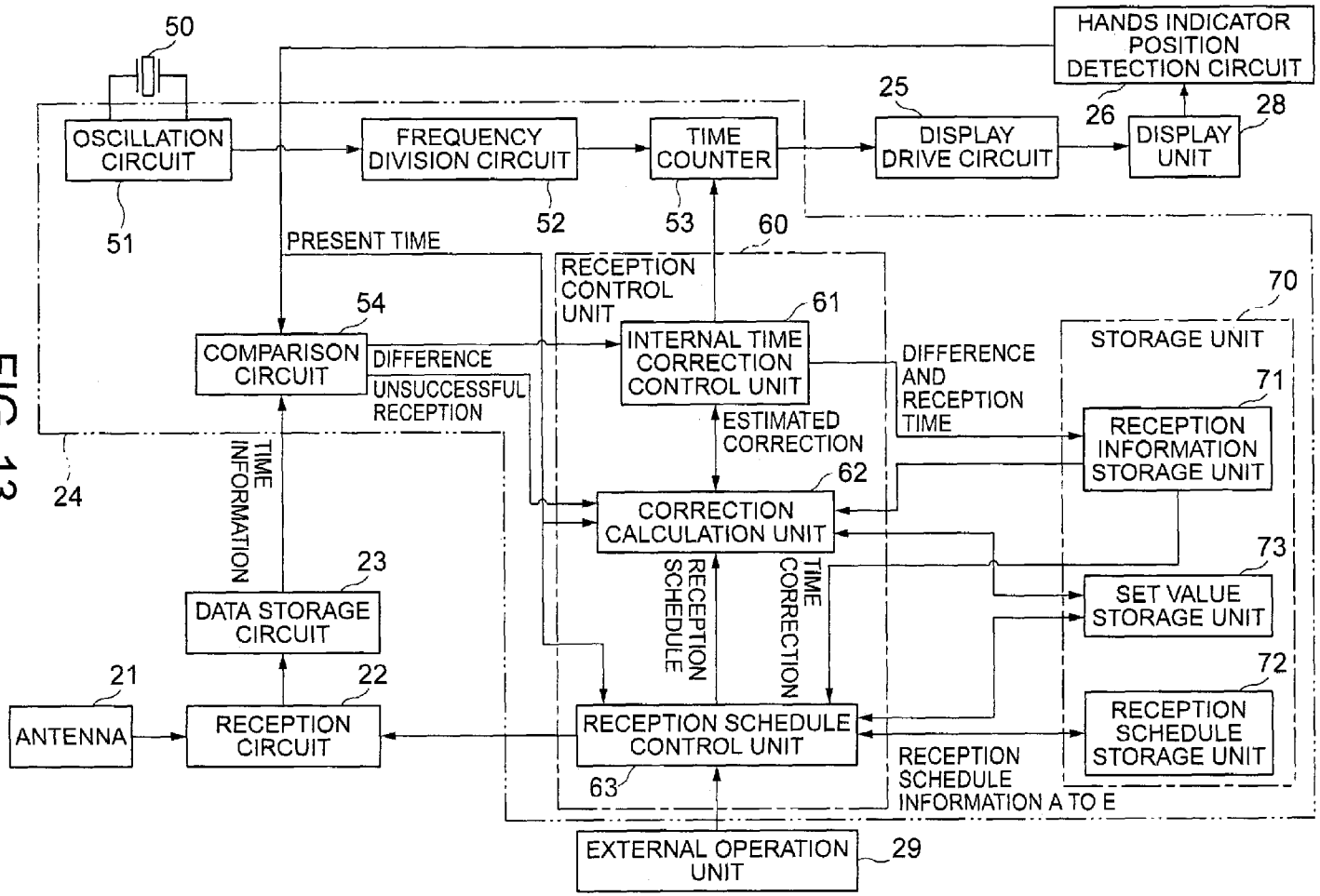
FIG. 13 is a block diagram showing the configuration of a control circuit according to a third embodiment of the present invention.

The radio wave correction timepiece 1 according to the third embodiment has the configuration of the first embodiment shown in FIG. 13, but is different in that information on unsuccessful radio wave reception is transferred from the comparison circuit 54 to the correction calculation unit 62 when radio wave reception is unsuccessful. As explained above, radio wave reception may be unsuccessful if a user of the radio wave correction timepiece 1 is inside a building or a subway, or radio wave reception may be unsuccessful due to troubles at the transmitter side, natural phenomena such as a magnetic storm. Configuration differences between the present third embodiment and that of the first embodiment is identified.

The comparison circuit 54 determines whether or not correct (i.e. valid) time information is received, and transfers the result of this determination to the correction calculation unit 62.

Figure 14:
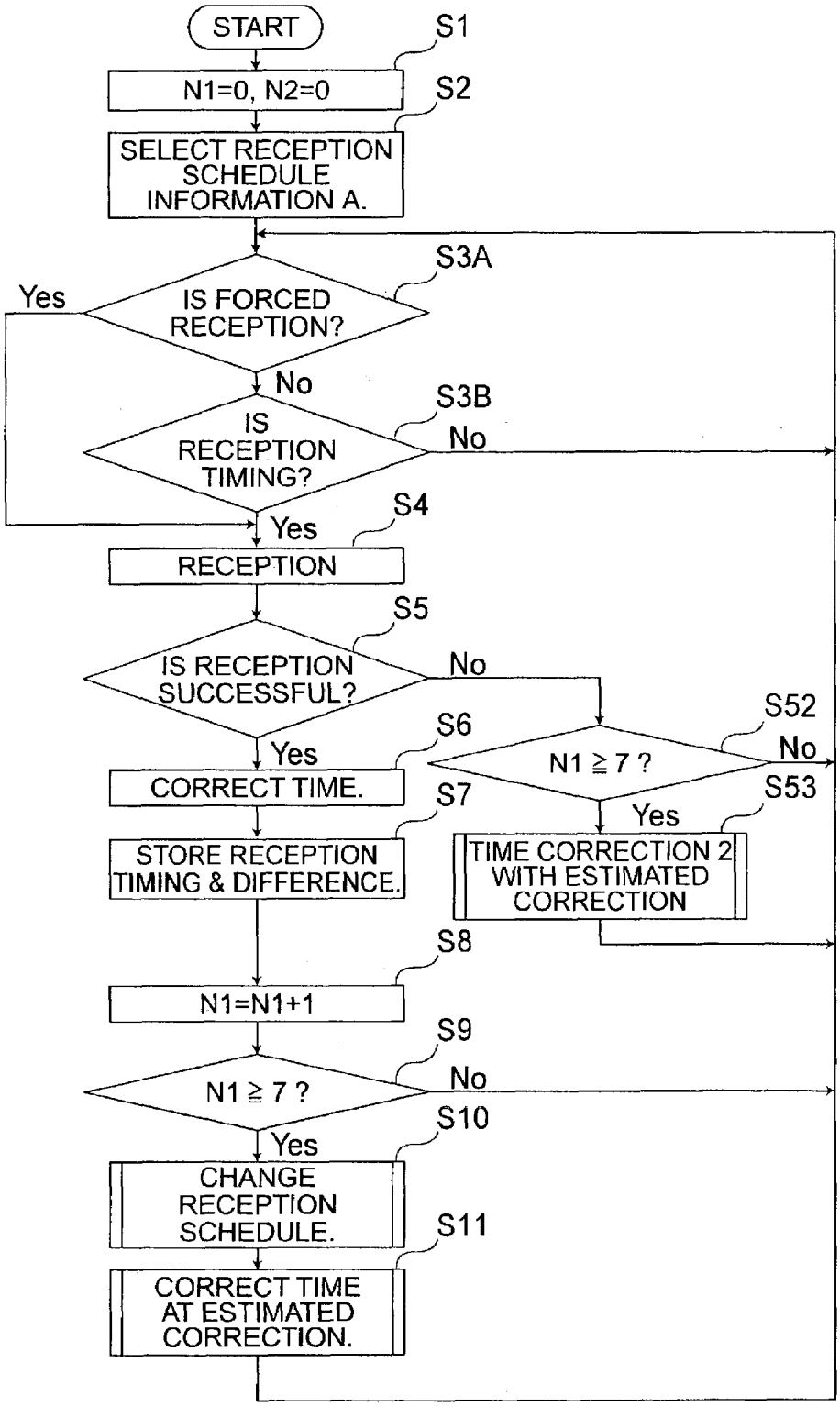
FIG. 14 is a flowchart showing the operation of the control circuit according to the third embodiment.

In the third embodiment, control is performed as shown in FIG. 14. As shown in FIG. 14, reception step (S4) is performed when the reception schedule control unit 63 determines that a forced reception command (S3A) was received, or when the scheduled time for information reception is reached (S3B).

Then, the comparison circuit 54 determines whether or not information reception is successful (S5). If it is determined that information reception is successful, then similar process steps as those of the first embodiment are subsequently performed.

On the other hand, if it is determined in step S5 that information reception is unsuccessful, then the correction calculation unit 62 determines whether or not information reception operations have been performed at least seven times in the past (S52). If the number of successful information reception operations is below seven, the calculation accuracy of the estimated correction value is deemed to be unreliable, and processing returns to step S3A without any further operation to wait for the presence of a forced reception command or for the next scheduled information reception operation.

If it is determined in step S52 that at least seven successful information reception operation have been performed in the past, the correction calculation unit 62 performs a time correction operation using an estimated correction value (S53).

Further time correction according to the present embodiment is the similar to that of the process flow shown in FIG. 12 of the second embodiment, and a description thereof will be omitted.

This embodiment includes not only every advantages of the first embodiment but also advantages listed below.

(11) If it is determined that information reception is unsuccessful in the comparison circuit 54, this information is sent to the correction calculation unit 62. Since time correction with the estimated correction value is performed by the correction calculation unit 62, further generation of a time indication error can be suppressed. Thus, for example, even when the radio wave could be received though correct time information could not be acquired because the radio wave was affected by the electromagnetic noise, or even when the standard wave could be received and correct time information could not be acquired because the user was inside a building or a subway, a time correction operation can still be performed using the estimated correction value. As a result, time indication is not deviated largely, and substantially correct time can be indicated consistently irrespective of external circumstances.

In addition, similar to the second embodiment, when radio wave reception cannot be performed, radio wave reception need not be reattempted, and power consumption can also be further reduced, accordingly.

The present invention is not limited to only each of the above embodiments, but may of course be modified in a various manner so long as not to be deviated from the purpose of the present invention.

Figure 5:
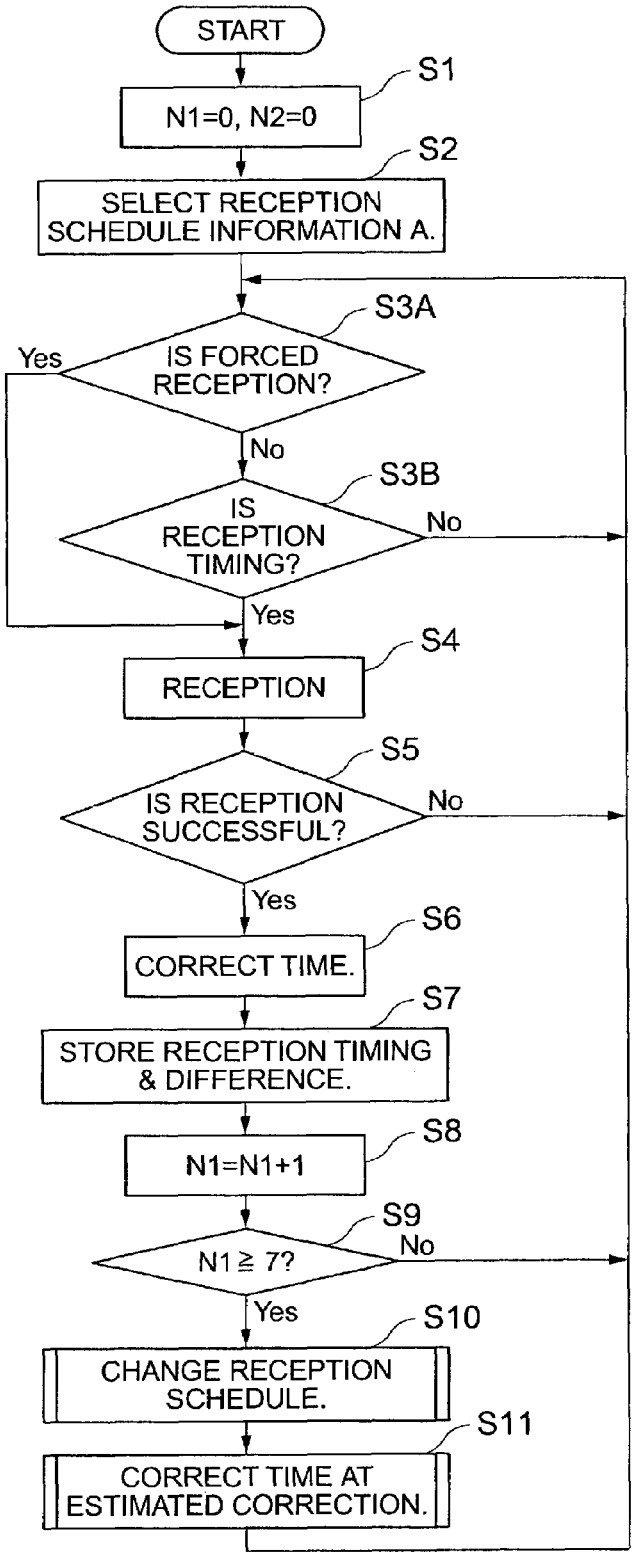
FIG. 5 is a flowchart showing the operation of a control circuit according to the first embodiment.

For example, in the flowchart in FIG. 5 of the first embodiment, if step S5 indicates that radio wave reception is unsuccessful, process control requires waiting till the next scheduled information reception time. However, similar to the third embodiment, even when step S5 indicates that radio wave reception is unsuccessful, a time correction operation may still be performed with an estimated correction value. In this method, if a user is by chance within a place difficult for radio wave reception, such as a building, a subway, or an underground passage, at the time when information reception is attempted, and cannot receive the radio wave, time correction can be performed with the estimated correction value and a large time deviation can be prevented.

And, in the embodiment, as shown in the flowchart of FIG. 6, if the average value of the time correction value is equal to or less than the first reference average value, or if the dispersion in the time correction value is equal to or less than the first reference dispersion value, the reception schedule is changed so that the reception interval is longer than the initially set value. However, only when the average value of the time correction value is equal to or less than the first reference average value, and the dispersion in the time correction value is equal to or less than the first reference average value, the reception schedule may be changed so that the reception interval is longer than the initially set value. In this method, only when both conditions are satisfied, the reception interval is prolonged, and only when the time correction value is small in fluctuation, and stable, the reception interval is prolonged, and the time indication error can be more reliably reduced.

Further, in the embodiment, as shown in the flowchart in FIG. 6, if the average value of the time correction value is not less than the second reference average value, or if the dispersion in the time correction value is not less than the second reference dispersion value, the reception schedule is changed so that the reception interval is shorter than the initially set value. However, only when the average value of the time correction value is not less than the second reference average value, and the dispersion in the time correction value is not less than the second reference dispersion value, the reception schedule may be changed so that the reception interval is shorter than the initially set value. In this method, only when both conditions are satisfied, the reception interval is shortened, priority can be given to suppression of the increase in power consumption required by reception compared with the increase in the time accuracy by shortening the reception interval, and this method is effective when providing the power-saving mode, etc.

In the second embodiment, control the process prohibits information reception if electromagnetic noise is detected. However, the process may permit attempting information reception but not permit the execution of a time correction operation based on the received data by invalidating the received data.

In the second and third embodiments, when no reception is performed or the radio wave cannot be received due to detection of electromagnetic noise, only the time correction is performed, and the radio wave reception is performed at the next reception timing. However, radio wave reception may be controlled to be performed again after the set time (for example, after one hour). In particular, when the present reception schedule information has a short reception interval like the information "e", and radio wave reception is performed if possible, such control is effective. On the other hand, if the reception schedule information has the reception interval set to be originally long like the information "b" to "d", no serious problem occurs even when the radio wave reception schedule is skipped once, and thus, control in the second embodiment is suitable.

If electromagnetic noise is also detected in the next reception, processing may be performed again after the set time.

In each of the above embodiments, the reception data for seven times in the past need not be continuous, the control is performed based on the simply received data for seven times in the past, but the control may be performed based on the successively received data according to the reception schedule.

In addition, in the embodiment, the schedule change is performed after receiving the radio wave seven times. However, as shown in graph (3) of FIG. 15, the schedule change may be performed after receiving the radio wave only three times. In short, reception timing data and difference data obtained by receiving the radio wave at least a plurality of times can be utilized.

In addition, the data number for obtaining the average value, etc. of the time correction value may be changed by the time correction value, etc. For example, as shown in graph (3) of FIG. 15, if the time correction value is stable at 0.1 seconds/day, time measurements are also considered to be stable, and information necessary for controlling the change of the reception schedule can be obtained even with a number as small as three. Therefore, if the time correction value is the same, the schedule change, etc. is performed in three times, and if the time correction value is not stable, the schedule change, etc. may be performed with more data in, for example, seven times.

In the above embodiment, the reception interval is changed by the average value and the dispersion of the time correction value. However, for example, as shown in graph (e) of FIG. 15, the reception interval may be changed according to whether or not the time correction value exceeds an allowable range (A=0.2 seconds/day). In addition, as shown in graph (4) of FIG. 15, two allowable ranges A1 and A2 with 0 seconds/day as the reference line are set. The reception interval is shortened every half day, if the time correction value exceeds the range A2, and prolonged every day if the time correction value is then returned to A1 or under.

Figure 15:
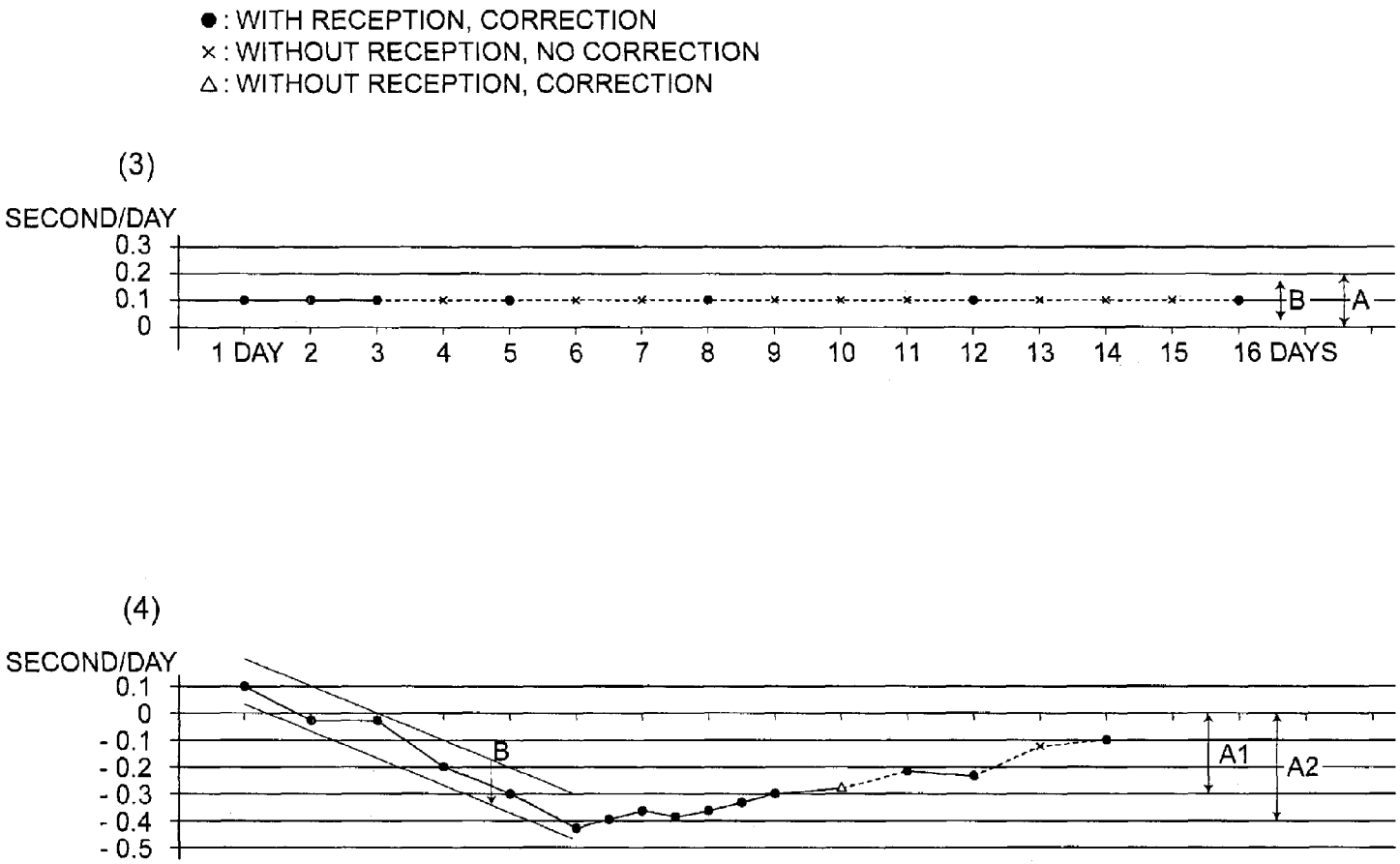
FIG. 15 is a graph showing the elapsed change of the time correction in a modification of the present invention.

In an example in graph (4) of FIG. 15, the time correction value on the sixth day remains within a range B in terms of the dispersion. However, the value exceeds the range A2, and the reception interval is shortened to be one half day.

Also in this case, it may also be determined whether or not the dispersion in the time correction value remains within the set value, for example, each time correction value is within the allowable range B (for example, 0.15 seconds/day). In addition, the reception interval may be changed only with this dispersion.

Further, in the above embodiment, both the average value and the dispersion of the time correction value are used. However, determination may be performed with only the average value or the dispersion.

In addition, each set value and each determination value may be set on the positive side or the negative side, or on both sides with 0 seconds/day as the reference, and may be appropriately set.

In addition, each set value and each determination value may be expanded or contracted in response to the elapse of time.

In addition, each set value and each determination value may be changed taking into consideration the seasonal fluctuation or the like. In particular, a quartz oscillator, etc. has its temperature characteristic in a strict sense, and if the outside temperature is different such as between the summer and the winter, the measuring accuracy is also different slightly. Therefore, the time correction value can be different in tendency according to the season, and control can be performed with higher accuracy if each set value and each determination value are set taking into consideration these factors.

Each set value and each determination value described above may be freely set when shipped from the factory or by a user, or changed from the preset options by operating a setting changing unit such as a winding crown and a button.

In addition, each set value and each determination value, together with various kinds of control programs may be installed or changed by the radio communication via the antenna 21 or the network communication via cables.

In each of the above embodiments, both the change of the reception schedule and the time correction with the estimated correction are performed. However, only the change of the reception schedule may be performed. If the time correction is also performed at the same time, the time indication error is reduced even when the reception interval is prolonged to be every three days or every four days, with the result that the reception interval can be expanded, and the power consumption can be considerably reduced to ⅓ to ¼ of the conventional value.

In addition, the reception schedule information is not limited to the information "a" to "e" described above, but may be one with longer reception interval (once/five days, once/10 days, etc.), or may be another with shorter reception interval (four time/day, etc.) In the above embodiment, the schedule information "a" to "d" is gradually selected in the order of information "a", "b", "c", and "d". However, each schedule information "a" to "e" may be selected directly according to, for example, the average value of the time correction value. For example, if the schedule information "a" is selected, and the average value of the time correction value is very small, the schedule information "d" may be selected directly next.

In addition, in each of the above embodiments, the reception schedule storage unit 72 is provided. However, the reception schedule may be calculated and set directly in the reception schedule control unit 63 without providing the reception schedule storage unit 72. For example, the reception schedule may be set by the average value by providing a routine program capable of calculating the reception interval with the average value of the time correction value as a parameter.

Regarding the prediction of the estimated correction from the data on the time of reception correction in the past, it is acceptable if the estimated correction can be predicted, and other embodiments than the above ones are included in the present invention.

Figure 16:
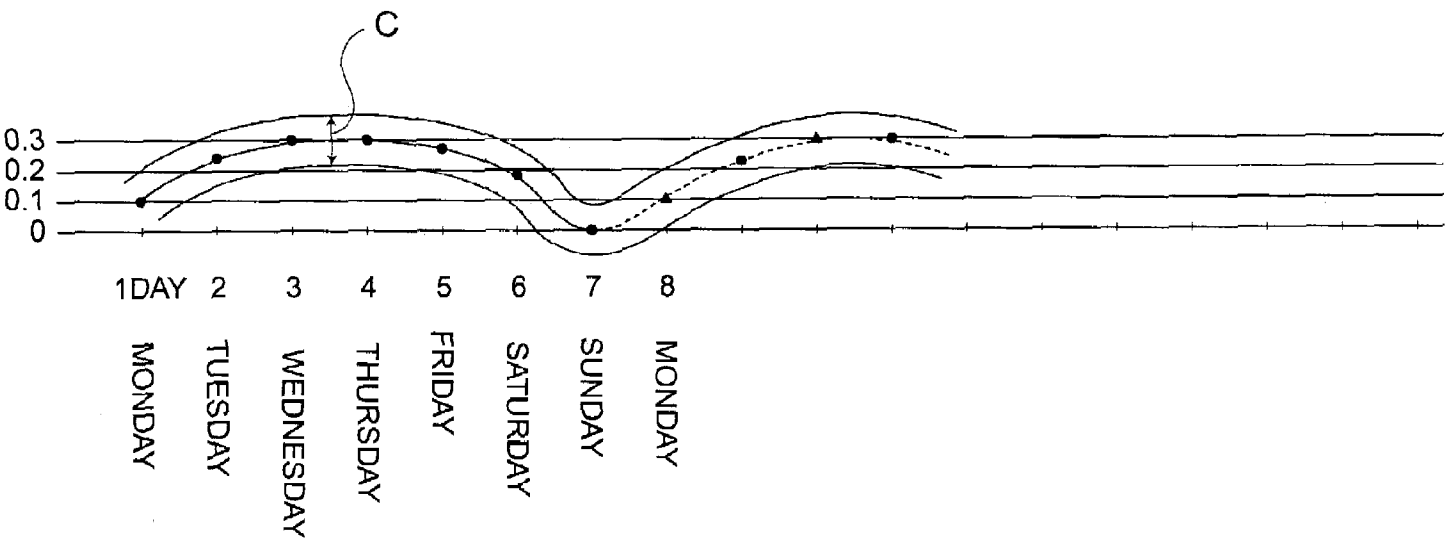
FIG. 16 are two graphs showing changes in the time interval between time correction operations in another modification of the present invention.

For example, in each of the above embodiments, the estimated correction is updated by successively utilizing the newly received data. However, as shown in FIG. 16, the data in one week (from Monday to Sunday) is received for the data in the past, the estimated correction for each day of the subsequent week may be calculated and corrected according to the data change in one week. More specifically, the data for one week is first accumulated, and then, the estimated correction may be used for each day of the week by utilizing the data for each day of the week for the data. In such cases, as shown in FIG. 16, each time correction must be present within the allowable range C set for the curve of the average value.

Regarding data acquisition, the data for one week may be acquired every one to several months. Alternatively, a manual data acquisition mode may be provided in which a user acquires the data for one week after the data acquisition instruction is given by the user.

In addition, the estimated correction for each day of the week may be calculated by accumulating the data for one to several weeks, not limited to the data for one week, and using the data for each day of the week.

In such cases, for example, when there is an influential difference in life cycle between the weekdays at work or in school and the holidays, the estimated correction can be performed taking into consideration the influence for each day of the week, and time correction with high accuracy can be performed when the life cycle is largely influential.

Figure 17:
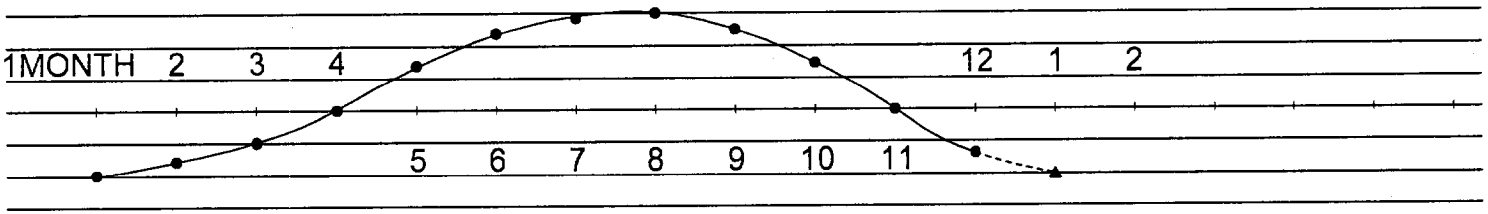
FIG. 17 is a graph showing changes in the time interval between time correction operations in a still another modification of the present invention.

In addition, for the data in the past, not limited to the data for one week, but the data for one year may be accumulated as shown in FIG. 17, the monthly correction is calculated to grasp the tendency in the data change, and the estimated correction is calculated and corrected from the next year based on the monthly correction of the data in the past before the previous year. In particular, if there are temperature changes according to the seasons as in Japan, the correction is also increased/decreased according to the temperature changes, and time correction with high accuracy can be performed by calculating the estimated correction according to each month.

The radio wave correction timepiece 1 may be provided with an indicating means for indicating the present reception schedule information and the number of elapsed days from the date of the last reception of the radio wave, etc., so that a user can easily grasp the present condition. Regarding this indicating means, the mode is switched to the schedule indication mode by using, for example, a winding crown and a button, indicating the scale on a dial plate by a second hand by 10 seconds through the instruction as the information "a" to "e", or by providing a liquid crystal screen on the dial plate.

In addition, whether the present time indicates the time corrected by the received radio wave, or the time corrected by the estimated correction, i.e., the kind of the time may be indicated by an indicating means of the liquid crystal screen, an organic EL screen, etc. This indication timing may be constantly made, or only for a predetermined time when a winding crown and a button is operated. In addition, the information on the kind of the time is not limited to the screen indication, but may be indicated by a special operation of the indicator for indicating the time, or an exclusive indication pointer hand.

Each means in the control circuit 24 may be constituted by the hardware such as various kinds of logical elements, or comprise a computer having a CPU (a central processing unit), and a memory (a storage device) disposed in the timepiece 1, with predetermined programs and data (the data stored in each storage unit) installed in the computer to realize each means.

For example, a CPU and a memory are disposed in the radio wave correction timepiece 1 so as to be functioned as the computer, the predetermined control programs and data are installed in this memory via communicating means such as Internet, and recording media such as CD-ROMs and memory cards, the CPU, etc. is operated by these installed programs to realize each means.

When the predetermined programs, etc. are installed in the radio wave correction timepiece 1, the memory cards, CD-ROMs, etc. may be inserted directly in the radio wave correction timepiece 1, or an appliance capable of reading these recording media may be externally connected to the radio wave correction timepiece 1. In addition, programs, etc. may be supplied through the communication by connecting LAN cables, telephone lines, etc. to the radio wave correction timepiece 1, and installed therein, or the programs may be supplied through radio using the antenna 21 provided thereon, and installed therein.

If the control programs, etc. provided using such recording media and communicating means such as Internet are installed in the radio wave correction timepiece 1, the function of each invention can be realized only by changing the programs, and the control programs can be installed when shipped from the factory, or the control programs desired by users can be selected and installed. In such cases, various kinds of radio wave correction timepieces 1 of different control mode can be manufactured only by changing the programs, parts can be commonly used, and the manufacturing cost when developing variation can be considerably reduced.

The function as the radio wave correction timepiece, i.e., each configuration of a measuring means, a receiving means, a time correcting means, etc. is not limited to that of the above embodiments, but each means of the radio wave correction timepiece which has been known can be used.

The radio wave correction timepiece 1 of the present invention is not limited to an analog type timepiece, but may be a digital type timepiece or a timepiece having both an indicator for analog display and a liquid crystal display unit for digital display. In addition, the radio wave correction timepiece 1 is applicable of various kinds of timepieces including portable timepieces such as a wristwatch and a watch, and installation type timepieces such as a wall timepiece and a timepiece to stand on a table.

In addition, external radio information is not limited to time information by the standard long wave. For example, it may be radio information by FM, GPS, Bluetooth, and non-contact IC card so long as it includes at least time information. It goes without saying that the configuration, etc. of the antenna 21 and the reception circuit 22 is appropriately changed according to the kind of the radio wave.

In addition, the electronic equipment of the present invention is not limited to that according to the above embodiments, but may be a master-slave timepiece or a repeater. Here, the master-slave timepiece means a timepiece in which time information of a parent timepiece is transmitted to a child timepiece by radio, etc., and the child timepiece performs time correction based on the time information. Thus, the parent timepiece comprising a wall timepiece and a timepiece to stand on a table is constituted of the electronic equipment of the present invention, the signal of the estimated correction calculated by the correction calculation unit of the parent timepiece is transmitted to the child timepiece, and the child timepiece (a wristwatch, a timepiece to stand on a table, etc.) may perform time correction by the estimated correction.

Alternatively, the parent timepiece transmits to the child timepiece the correction (difference between internal and external time data) when receiving external radio information such as radio wave at the predetermined reception interval by the reception schedule control unit, and the child timepiece may perform time correction based on the correction.

Similarly, the present invention may be applied to the repeater which receives external radio information and transfers it to timepiece devices, etc., and similar to the above parent timepiece, the estimated correction signal and the signal of the correction by the radio wave received at the predetermined reception interval are transmitted to a measuring device, and the measuring device receives the information, and performs time correction to indicate correct time.

In addition, the electronic equipment of the present invention is not limited to a radio wave correction timepiece, but any timepiece such as a personal computer, an electronic toy, and a timer which performs any processing or operation by utilizing correct time information. In particular, the present invention is effective in reducing power consumption, and suitable for a battery-driven portable electronic equipment. In this occasion, the electronic equipment is not limited to ones using a regular primary battery, but may be ones having various kinds of generators such as a solar battery. This type of electronic equipment is also advantageous in that the power consumption can be reduced, and the duration can be prolonged.

[Other Embodiments of the Present Invention]

Other embodiments of the present invention will be described below.

A reception control method of the electronic equipment according to a first embodiment is a reception control method of the electronic equipment having an external radio information reception unit for receiving external radio information including time information and an internal time measuring unit for measuring the internal time based on the reference clock, and comprises a time data comparison step of comparing external time data forming time information received by the external radio information reception unit with internal time data measured by the internal time measuring unit, and outputting the difference therebetween, a reception information storage step of storing at least a plurality of sets of each data on the timing of receiving the external radio information by the external radio information reception unit and the difference thereof, a correction calculation step of calculating the estimated correction by the plurality of sets of reception timing data, difference data, and the elapsed time from the last reception, and an internal time correction control step of correcting the internal time by using the estimated correction.

A second embodiment further comprises a schedule control step of controlling the reception schedule in the external radio information reception unit in the first embodiment, and the internal time correction control step is characterized in that the internal time is corrected by using the estimated correction if time information is unsuccessfully acquired when external radio information is received based on the reception schedule.

A third embodiment further comprises a schedule control step of controlling the reception schedule in the external radio information reception unit according to the first or second embodiment, and the internal time correction control step is characterized in that the internal time is corrected by using the estimated correction if no reception is performed though at the reception timing with the reception schedule of the initially set value because the reception schedule is changed by the reception schedule control step.

A fourth embodiment further comprises an external operation unit of instructing the forced reception of external radio information by the external radio information reception unit according to any one of the first to third embodiments, and the internal time correction control step is characterized in that the internal time is corrected by using the estimated correction if time information by receiving the external radio information is unsuccessfully acquired when the forced reception is instructed by operating the external operation unit by a user.

A fifth embodiment further comprises a magnetic field detection unit for detecting electromagnetic noise according to any one of the first to third embodiments, and is characterized in that a reception processing control step of prohibiting reception operation or invalidating reception data by the external radio information reception unit when detecting electromagnetic noise by the magnetic field detection unit is provided.

A sixth embodiment further comprises a reception schedule control step of controlling the reception schedule in the external radio information reception unit according to the fifth embodiment, and the internal time correction control step is characterized in that the internal time is corrected by using the estimated correction if electromagnetic noise is detected by the magnetic field detection unit, and reception operation is prohibited or the reception data is invalidated, and time information is unsuccessfully acquired in the reception control step when receiving external radio information based on the reception schedule.

A seventh embodiment comprises an external operation unit for instructing the forced reception of external radio information by the external radio information reception unit according to the fifth or sixth embodiment, and the internal time correction control step is characterized in that the internal time is corrected by using the estimated correction if electromagnetic noise is detected by the magnetic field detection unit, and reception operation is prohibited or reception data is invalidated in the reception control step, and time information is unsuccessfully acquired in case the forced reception is instructed by operating the external operation unit by a user.

An eighth embodiment is a reception control method of an electronic equipment having an external radio information reception unit for receiving external radio information including time information, and an internal time measuring unit for measuring the internal time based on the reference clock, and comprises a time data comparison step of comparing external time data forming time information received by the external radio information reception unit with internal time data measured by the internal time measuring unit to output the difference therebetween, a reception information storage step of storing at least a plurality of sets of each data on the timing of receiving the external radio information by the external radio information reception unit and the difference thereof, and a schedule control step of controlling the reception schedule by the external radio information reception unit based on the plurality of sets of reception timing data and the difference data stored in the reception information storage unit.

A ninth embodiment is characterized in that, according to any one of the second, third, sixth, and eighth embodiments, the reception schedule installation step changes the reception schedule so that the reception interval is longer than the initially set value when the average value of the time correction value per unit time, obtained by the reception timing and the difference thereof, is small and equal to or less than the first set value for the average value, and/or when the dispersion in the time correction value is small and equal to or less than the first set value for the dispersion.

A tenth embodiment is characterized in that, according to the ninth embodiment, the reception schedule control step changes the reception schedule so that the reception interval is longer than the initially set value by skipping the reception timing in the initially set reception schedule for at least once.

An eleventh embodiment is characterized in that, according to any one of the second, third, sixth, eighth, ninth, and tenth embodiments, the reception schedule control step changes the reception schedule so that the reception interval is shorter than the initially set value if the average value of the time correction per unit time, obtained by the reception timing and the difference thereof, is large and equal to or greater than the second reference average value, and/or if the dispersion in the time correction for each reception timing is large and equal to or greater than the second reference dispersion value.

The twelfth embodiment comprises a reception schedule storage unit storing a plurality of sets of reception schedule information in the external radio information reception unit according to any one of the second, third, sixth, eighth, ninth, tenth, and eleventh embodiments, and is characterized in that the reception schedule control step controls the reception schedule by selecting reception schedule information of the reception schedule storage unit of the reception schedule.

A thirteenth embodiment is characterized in that, according to any one of the first to seventh embodiments, the internal time correction control step corrects the internal time by using the estimated correction if the estimated correction calculated by the correction calculation unit is large and equal to or greater than the correction determination value.

A fourteenth embodiment is characterized in that, according to any one of the first to thirteenth embodiments, a plurality of sets of reception timing data and difference data stored in the reception information storage step is the data of the latest predetermined number out of a plurality of sets of data received in the past.

A fifteenth embodiment comprises a setting changing step according to any one of the first to fourteenth embodiments and is characterized in that setting of at least one of each set value and each determination value is changed.

A sixteenth embodiment is characterized in that, according to any one of the first to fifteenth embodiments, the electronic equipment is a radio wave correction timepiece having a display step of displaying the internal time measured by the internal time measuring unit.

A reception control program of an electronic equipment according to a seventeenth embodiment is characterized in that a computer built in the electronic equipment having an external radio information reception unit for receiving external radio information including time information and an internal time measuring unit for measuring the internal time based on the reference clock is functioned as a time data comparison unit for comparing external time data forming time information received by the external radio information reception unit with internal time data measured by the internal time measuring unit, and outputting the difference thereof, a reception information storage unit storing at least a plurality of sets of each data on the timing of receiving the external radio information by the external radio information reception unit and the difference thereof, a correction calculation unit for calculating the estimated correction by the plurality of sets of reception timing data, difference data, and the elapsed time from the last reception, and an internal time correction control unit for correcting the internal time by using the estimated correction.

A reception control program of an electronic equipment according to an eighteenth embodiment is characterized in that a computer built in the electronic equipment having an external radio information reception unit for receiving external radio information including time information and an internal time measuring unit for measuring the internal time based on the reference clock is functioned as a time data comparison unit for comparing external time data forming time information received by the external radio information reception unit with internal time data measured by the internal time measuring unit, and outputting the difference thereof, a reception information storage unit storing at least a plurality of sets of each data on the timing of receiving the external radio information by the external radio information reception unit and the difference thereof, and a reception schedule control unit for controlling the reception schedule in the external radio information reception unit based on a plurality of sets of reception timing data and difference data stored in the reception information storage unit.

A reception control program of an electronic equipment according to another embodiment of the present invention is a program for executing the reception control method according to the first to sixteenth embodiments by a computer built in the electronic equipment having an external radio information reception unit for receiving external radio information including time information, and an internal time measuring unit for measuring the internal time based on the reference clock.

In addition, a computer-readable recording medium according to another embodiment is a computer-readable recording medium recording a program for executing the reception control method according to the first to sixteenth embodiments in a computer built in the electronic equipment having an external radio information reception unit for receiving external radio information including time information and an internal time measuring unit for measuring the internal time based on the reference clock.

Similar operational advantages to those of the electronic equipment can also be obtained by these methods, programs and recording media.

In addition, in this invention, the set value and the determination value can be easily changed when the computer is operated by the program. This means, if programs are provided, they can be installed in the electronic equipment via the recording media such as CD-ROMs and communicating means such as Internet, and the detection level of the external magnetic field can be optimally and easily set according to the characteristic of each electronic equipment, and reception control of higher accuracy can be performed.

[Advantages]

As described above, the electronic equipment and the reception control method of the electronic equipment of the present invention, time correction can be performed by the estimated correction when electromagnetic noise is detected, or unsuccessful radio wave reception is detected, and a first advantage can be obtained in that substantially correct time data can be output even if correct time information cannot be acquired.

In addition, a second advantage can be obtained in that correct time data can be output while reducing the power consumption required for the reception if provided with a reception schedule control unit for controlling the reception schedule based on reception timing data and difference data.

Still in addition to the second advantage, a third advantage can be obtained in that the power consumption required for the reception can be reduced, and correct time data can be output even when correction is increased if provided with a correction calculation unit by the estimated correction.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An electronic equipment comprising:

a radio information reception unit for receiving external radio information including time information having external time data;

an internal time measuring unit for measuring the internal time based on a reference clock;

a time data comparison unit for comparing external time data received by said radio information reception unit with internal time data measured by said internal time measuring unit, and for outputting the difference therebetween as difference data;

a storage unit for storing at least a plurality of data sets, each data set including the observed time when each external time data is received and the corresponding difference data determined from the received external time data;

a reception control unit having a correction calculation unit for calculating an estimated correction value using said plurality of data sets and the elapsed time since the last information reception operation of said radio information reception unit; and an internal time correction control unit for correcting the internal time by using said estimated correction value when reception of said external radio information having external time data fails.

2. An electronic equipment according to claim 1;

wherein said reception control unit further has a reception schedule control unit for controlling an information reception schedule of said radio information reception unit; and wherein said internal time correction control unit corrects the internal time by using said estimated correction value when time information received by said radio information reception unit according to said reception schedule is deemed to be invalid.

3. An electronic equipment according to claim 2, wherein said reception schedule control unit changes the information reception schedule so that a reception interval, defined as a time interval between scheduled information reception operations, is made longer than an initially set value when at least one of the following conditions is met:

a) an average of difference data is not greater than a first reference average value;

b) a dispersion measure of said difference data is not greater than a first reference dispersion value.

4. An electronic equipment according to claim 3, wherein said reception schedule control unit changes the information reception schedule so that said reception interval is longer than the initially set value by skipping a scheduled information reception operation in the information reception schedule.

5. An electronic equipment according to claim 3, wherein said reception schedule control unit further changes the information reception schedule so that the reception interval is shorter than the initially set value when at least one of the following conditions is met:

c) the average of difference data is not less than a second reference average value;

d) a dispersion measure of said difference data is not less than a second reference dispersion value.

6. An electronic equipment according to claim 5, wherein said internal time correction control unit corrects the internal time by using the estimated correction value if the estimated correction value is not less than a predefined reference determination value.

7. An electronic equipment according to claim 6, further having a reference-changing unit for selectively changing the value of at least one of said first reference average value, second reference average value, first reference dispersion value, second reference dispersion value, and reference determination value.

8. An electronic equipment according to claim 2,wherein said reception schedule control unit changes the information reception schedule so that the reception interval is shorter than the initially set value when at least one of the following conditions is met:

c) the average of difference data is not less than a second reference average value;

d) a dispersion measure of said difference data is not less than a second reference dispersion value.

9. An electronic equipment according to claim 2, wherein said storage unit is further effective for storing a plurality of reception schedules; and wherein said reception schedule control unit controls the information reception schedule of said radio information reception unit by selecting at least one of said plurality of reception schedules stored in said storage unit.

10. An electronic equipment according to claim 1;

wherein said reception control unit further has a reception schedule control unit for controlling an information reception schedule, said reception schedule control unit being effective for instructing said radio information reception unit when to attempt information reception in accordance with said information reception schedule; and wherein said internal time correction control unit corrects the internal time at periods dependent on said information reception schedule, and said internal time correction control unit corrects the internal time by using said estimated correction value when valid external time data is not acquired at a time indicated by said information reception schedule.

11. An electronic equipment according to claim 10, wherein valid external time data is not acquired due to data corruption in external radio information received, at a time indicated by said information reception schedule, by said radio information reception unit.

12. An electronic equipment according to claim 10, wherein valid external time data is not acquired due to no information reception operation being attempted at a time indicated by said information reception schedule due to said reception schedule control unit not instructing said radio information reception unit to attempt information reception.

13. An electronic equipment according to claim 1 further having an externally operable input unit for inputting a forced reception command instructing said radio information reception unit to execute an information reception operation for external radio information;

wherein said internal time correction control unit corrects the internal time in response to said forced reception command by using said estimated correction value if time information in said external radio information is deemed invalid.

14. An electronic equipment according to claim 1 further having an electromagnetic noise detector;

wherein said reception control unit further has a reception processing control unit for prohibiting said radio information reception unit from executing an information reception operation or for invalidating received data if electromagnetic noise is detected by said electromagnetic noise detector.

15. An electronic equipment according to claim 14, wherein said electromagnetic noise detector is a magnetic field detection unit.

16. An electronic equipment according to claim 14;

wherein said reception control unit has a reception schedule control unit for controlling an information reception schedule of said radio information reception unit; and wherein, if external radio information is received based on said reception schedule, said internal time correction control unit corrects the internal time by using said estimated correction value if electromagnetic noise is detected by said electromagnetic noise detector.

17. An electronic equipment according to claim 14, further having an externally operable input unit for inputting a forced reception command instructing to said radio information reception unit to execute an information reception operation for external radio information;

wherein said internal time correction control unit corrects the internal time in response to said forced reception command by using said estimated correction value if electromagnetic noise is detected by said electromagnetic noise detector.

18. An electronic equipment according to claim 1, wherein said internal time correction control unit corrects the internal time by using the estimated correction value if the estimated correction value is not less than a predefined reference determination value.

19. An electronic equipment according to claim 18, further having a reference-changing unit for selectively changing the value of said predefined reference determination.

20. An electronic equipment according to claims 1, wherein the quantity of data sets stored in said storage unit is limited to a predefined number of the most recently created data sets.

21. An electronic equipment according to claim 1, further comprising a radio wave correction timepiece having a display unit to indicate the internal time measured by said internal time measuring unit.

22. An electronic equipment according to claim 3, wherein said average is taken of a predefined number of the most recently, consecutively, obtained difference data entries.

23. An electronic equipment according to claim 3, wherein said dispersion measure is made of a predetermined number of the most recently, consecutively, obtained difference data entries.

24. An electronic equipment according to claim 5, wherein said average is taken of a predefined number of the most recently, consecutively, obtained difference data entries.

25. An electronic equipment according to claim 5, wherein said dispersion measure is made of a predetermined number of the most recently, consecutively, obtained difference data entries.

26. An electronic equipment according to claim 8, wherein said average is taken of a predefined number of the most recently, consecutively, obtained difference data entries.

27. An electronic equipment according to claim 8, wherein said dispersion measure is made of a predetermined number of the most recently, consecutively, obtained difference data entries.

28. A reception control method of an electric equipment having a radio information reception unit for receiving external radio information including external time data and an internal time measuring unit for generating internal time data based on a reference clock, comprising:

a time data comparison step of comparing external time data received by said radio information reception unit with internal time data generated by said internal time measuring unit, and of outputting the difference therebetween as difference data;

a reception information storage step of storing at least a plurality of data sets, each data set including the observed time when each external time data is received and the corresponding difference data determined from the received external time data;

a correction calculation step of calculating an estimated correction value using said plurality of data sets and the elapsed time since the last information reception operation; and an internal time correction control step of correcting the internal time by using said estimated correction value if said external time data is not successfully received when said radio information reception unit is receiving said external radio information.

* * * * *